US012121144B1

(12) United States Patent
Johns

(10) Patent No.: US 12,121,144 B1
(45) Date of Patent: Oct. 22, 2024

(54) UMBRELLA AND PORTABLE STAND

(71) Applicant: Stephen Johns, Merritt Island, FL (US)

(72) Inventor: Stephen Johns, Merritt Island, FL (US)

( * ) Notice: Subject to any disclaimer, the term of this patent is extended or adjusted under 35 U.S.C. 154(b) by 0 days.

(21) Appl. No.: 18/593,453

(22) Filed: Mar. 1, 2024

Related U.S. Application Data

(63) Continuation-in-part of application No. 18/110,127, filed on Feb. 15, 2023, now Pat. No. 11,952,793.

(51) Int. Cl.
*A47B 37/04* (2006.01)
*E04H 4/14* (2006.01)
*E04H 12/22* (2006.01)

(52) U.S. Cl.
CPC ..... *A47B 37/04* (2013.01); *E04H 4/14* (2013.01); *E04H 12/2261* (2013.01); *E04H 12/2269* (2013.01); *A45B 2200/1063* (2013.01)

(58) Field of Classification Search
CPC ..... A47B 37/04; A47B 5/02; A47B 23/02; A47B 23/04; A47B 2220/0008; A47B 13/16; A47B 83/04; E04H 12/2246; E04H 4/144; E04H 4/14; E04H 12/2269; E04H 12/2261; A47G 23/0208; A45B 2200/1063
USPC ..... 248/910, 519
See application file for complete search history.

(56) References Cited

U.S. PATENT DOCUMENTS 332,917 A * 12/1885 Markham ..... H01Q 1/1221 248/539
2,123,257 A 7/1938 Eusebe
2,190,222 A 2/1940 Strasser
3,036,717 A 5/1962 Johnson
3,395,692 A 8/1968 Mansel
3,624,732 A 11/1971 Bowden
4,903,926 A * 2/1990 McNarry ..... E04H 4/14 4/496
5,228,148 A 7/1993 Weir
5,333,322 A 8/1994 Weir
5,427,346 A 6/1995 Urgola
5,505,645 A 4/1996 Engler, Jr.
5,572,750 A 11/1996 Johnston
(Continued)

FOREIGN PATENT DOCUMENTS

CA 3071347 A1 * 2/2021 ..... E04F 11/18
ES 2448965 A1 * 3/2014 ..... A45C 11/00
ES 2661266 A1 * 3/2018 ..... E04H 4/12

*Primary Examiner* — Taylor Morris
(74) *Attorney, Agent, or Firm* — Steinberger IP Law; Brian S. Steinberger; Hilary F. Steinberger

(57) ABSTRACT

Pool stands, trays, devices, and methods for supporting beverage containers on the edge of a swimming pool while supporting a pool umbrella. One embodiment of the stand can be generally disc shaped with a lower front step portion, and a through-hole passing through the stand to allow an umbrella post to be supported therein. A clamping screw knob can lock the umbrella post to the stand. The stand can be positioned on the edge of a swimming pool so that shade from the umbrella can be provide to person(s) in the pool. Another embodiment can have a generally rectangular configuration with a lower front step portion that can also be positioned on the edge of a swimming pool so that shade from the umbrella can be provided to person(s) in the pool. The interior of the stands can be hollow, and can be filled with a ballast, such as sand or water.

20 Claims, 35 Drawing Sheets

(56) References Cited

U.S. PATENT DOCUMENTS 5,636,649 A * 6/1997 Horvath ..... A45B 11/00 135/96
5,760,751 A 6/1998 Gipson
5,803,265 A 9/1998 Bergerman
5,829,723 A 11/1998 Brunner
5,996,511 A 12/1999 Swoger
6,061,850 A 5/2000 Roper, III
6,101,955 A 8/2000 Salce
6,138,966 A 10/2000 Smith
6,139,382 A 10/2000 Eschbacher
6,314,891 B1 * 11/2001 Larson ..... B60N 3/001 224/521
6,354,554 B1 3/2002 Hollenbeck
6,474,244 B1 11/2002 Karpinski
6,554,012 B2 4/2003 Patarra
6,676,094 B1 1/2004 Brown
6,796,319 B1 9/2004 Patarra
6,862,755 B1 3/2005 Crachy
6,889,618 B1 5/2005 Gromack
6,931,998 B1 8/2005 Leese
6,976,434 B2 12/2005 Roig
7,334,593 B2 * 2/2008 Avery ..... A45B 1/00 248/541
7,386,896 B2 6/2008 Spicer
8,381,662 B2 2/2013 Goldszer
8,393,343 B2 3/2013 VanVonderen
8,397,648 B1 3/2013 Palladino
9,150,235 B2 10/2015 Galante
9,192,214 B2 11/2015 Gambill
9,220,337 B1 12/2015 Wenzel
9,392,868 B2 7/2016 Nardi
9,402,469 B2 * 8/2016 Finstad ..... A47B 37/04
9,463,850 B2 10/2016 Lovett
9,655,437 B2 5/2017 Clause
9,661,917 B2 5/2017 Dias
9,706,820 B1 7/2017 Lopez
10,161,150 B1 * 12/2018 Kirk ..... E04H 4/14
10,272,976 B1 4/2019 Newhall
10,624,479 B2 * 4/2020 Thomas ..... A47C 7/68
11,311,103 B1 4/2022 Wilson
11,401,011 B2 8/2022 Johns
11,873,657 B1 * 1/2024 Yanes ..... E04H 4/14
2004/0077235 A1 4/2004 Cloutier
2005/0039639 A1 2/2005 Espenschied
2005/0241546 A1 11/2005 Royse
2006/0017354 A1 1/2006 DeMars
2009/0000523 A1 1/2009 Ciardelli
2011/0185491 A1 8/2011 Roberts
2012/0061411 A1 * 3/2012 Singh ..... E04H 4/14 220/737
2012/0118902 A1 5/2012 Beltrante
2014/0102337 A1 4/2014 Ralph
2015/0000716 A1 1/2015 LeAnna
2015/0208634 A1 7/2015 Box
2018/0249838 A1 9/2018 Melaragno
2018/0298929 A1 10/2018 Lund
2019/0343274 A1 * 11/2019 Cass ..... A47C 7/626
2021/0145169 A1 5/2021 Schwiebert
2021/0401164 A1 * 12/2021 Cass ..... A47C 17/86
2022/0133070 A1 5/2022 Colin
2022/0268049 A1 8/2022 Frerich
2023/0064396 A1 3/2023 Foley

* cited by examiner

UMBRELLA AND PORTABLE STAND

CROSS REFERENCE TO RELATED APPLICATIONS

This application is a Continuation-In-Part of U.S. patent application Ser. No. 18/110,127 filed Feb. 15, 2023, now allowed, the entire disclosure which is incorporated by reference in its' entirety.

FIELD OF INVENTION

This invention relates to swimming pool accessories, and in particular to stands, trays, devices, and methods for supporting beverage containers on the edge of a swimming pool while supporting a pool umbrella.

BACKGROUND AND PRIOR ART

Swimming pools are popular locations for people in the pools to stand and socialize.

Thus, the need exists for solutions to the above problems with the prior art. Often it is enjoyable to enjoy a beverage while in the pool. However, balancing a liquid container such as a can, bottle and glass on the edge of a pool is not desirable, since the liquid in the beverage container can easily spill out.

Floating chairs have become popular for having a beverage holder in the armrest. However, the user must be seated in the chair to use the beverage holder, which is not always available or desirable.

Still furthermore, the floating chairs do not provide any shade for the user. Devices have been proposed over the years to incorporate a beverage and umbrella stand. See for example, U.S. Pat. No. 5,228,148 to Weir; U.S. Pat. No. 5,333,322 to Weir and U.S. Pat. No. 6,474,244 to Karpinski.

However, the Weir devices are elaborate molded seats that sit in the pool, and are large and cumbersome to use and move, and are not inexpensive to make.

Karpinski '244, requires an elaborate leg and angled support leg that extends below the tray, and is not desirable to pool users.

Additionally, the above referenced prior art devices would be expensive to manufacture and not be inexpensive to the end user. These devices would also not be desirable, since they take up substantial amounts of space in the pools when being used, and take up substantial space when being stored.

Thus, the need exists for solutions with the problems of the prior art.

SUMMARY OF THE INVENTION

A primary objective of the present invention is to provide pool stands, trays, devices, and methods for supporting beverage containers on the edge of a swimming pool while supporting a pool umbrella that is easy to use when needed.

A secondary objective of the present invention is to provide pool stands, trays, devices, and methods for supporting beverage containers on the edge of a swimming pool while supporting a pool umbrella that is inexpensive to manufacture and sell.

A third objective of the present invention is to provide pool stands, trays, devices, and methods for supporting beverage containers on the edge of a swimming pool while supporting a pool umbrella that is formed from a metal plate having a bent edge for overlying the copa edge of a pool.

Preferred embodiments of the stands can include a hollow plastic base for allowing the post of an umbrella to pass there-through. The purpose is to allow the shade of the umbrella to drop closer to the surface on which the base is setting.

The main purpose of this base is to allow the shade of the umbrella to be within inches of a person in the swimming pool for allowing maximum shade.

The base can be hollow with a fill cap to allow it to be filled with water or sand for stability and ballast.

The base can have a tear drop shaped through-hole so that when the clamping screw is tightened, it forces the post into the wedge shape side of the teardrop through-hole, keeping the umbrella stable.

The clamping screw also allows the installer to raise and lower the umbrella with east. The base can have a plurality of cup holder molded into the body, along with a recess in the top and a lip on the bottom allowing the base to be stacked without sliding apart.

Another embodiment of the beverage tray and umbrella stand for use with a pool, can include a metal plate having and upper surface and a lower surface, with a front portion and a rear portion a nonmetal layer on the upper surface with at least one indentation for supporting a beverage container therein, the front portion of the metal plate having a downward vertical bent portion and an inward bent step portion, and a through-hole passing from the upper surface to the lower surface for allowing a post of an umbrella to be supported therein, wherein the vertical bent portion with the inward bent step is adapted to abut a pool coping edge of a swimming pool, and wherein ballast resting on top of the nonmetal layer adjacent the rear portion stabilizes the stand.

The nonmetal layer includes a plurality of generally circular indentations for supporting a plurality of beverage containers therein.

The beverage tray and umbrella stand can include a rotatable knob with a threaded stem adjacent to the through-hole for locking the umbrella to the stand.

The through-hole can include a tear drop configuration, so that an umbrella post is pushed into a narrow portion of the tear drop configuration by the threaded stem of the rotatable knob.

The through-hole can include a triangular configuration, so that an umbrella post is pushed into a narrow portion of the tear drop configuration by the threaded stem of the rotatable knob The metal plate can be an aluminum plate or galvanized metal.

The stand can be configured to be stackable with an identical stand.

The nonmetal layer can include a rear surface portion adapted for supporting a portable cooler as the ballast thereon.

The nonmetal layer can include a rear surface portion adapted for supporting a plant as the ballast thereon.

The nonmetal layer can include a rear surface portion adapted for supporting an approximately 35 pound weight as the ballast thereon.

The nonmetal layer can include at least one opening for mounting a support post of a portable phone holder thereon.

The embodiment can include a kit having a metal plate having and upper surface and a lower surface, with a front portion and a rear portion, the upper surface having a nonmetal layer with a plurality of indentations for supporting a beverage container therein, the front portion of the metal plate having a downward vertical bent portion and an inward bent step portion, a through-hole passing from the upper surface to the lower surface, wherein the vertical bent portion with the inward bent step is adapted to abut a pool coping edge of a swimming pool, a rotatable knob with a threaded stem passing through the vertical bent portion adjacent to the through-hole, and an umbrella with a post that is inserted into the through for locking the umbrella to the stand, wherein ballast resting on top of the upper surface of the nonmetal layer adjacent the rear portion stabilizes the stand.

The kit can further include a cooler as the ballast.

Further objects and advantages of this invention will be apparent from the following detailed description of the presently preferred embodiments which are illustrated schematically in the accompanying drawings.

BRIEF DESCRIPTION OF THE FIGURES

The drawing figures depict one or more implementations in accord with the present concepts, by way of example only, not by way of limitations. In the figures, like reference numerals refer to the same or similar elements.

First Embodiment Circular Stand

Second Embodiment Rectangular Stand

Figure 6A:
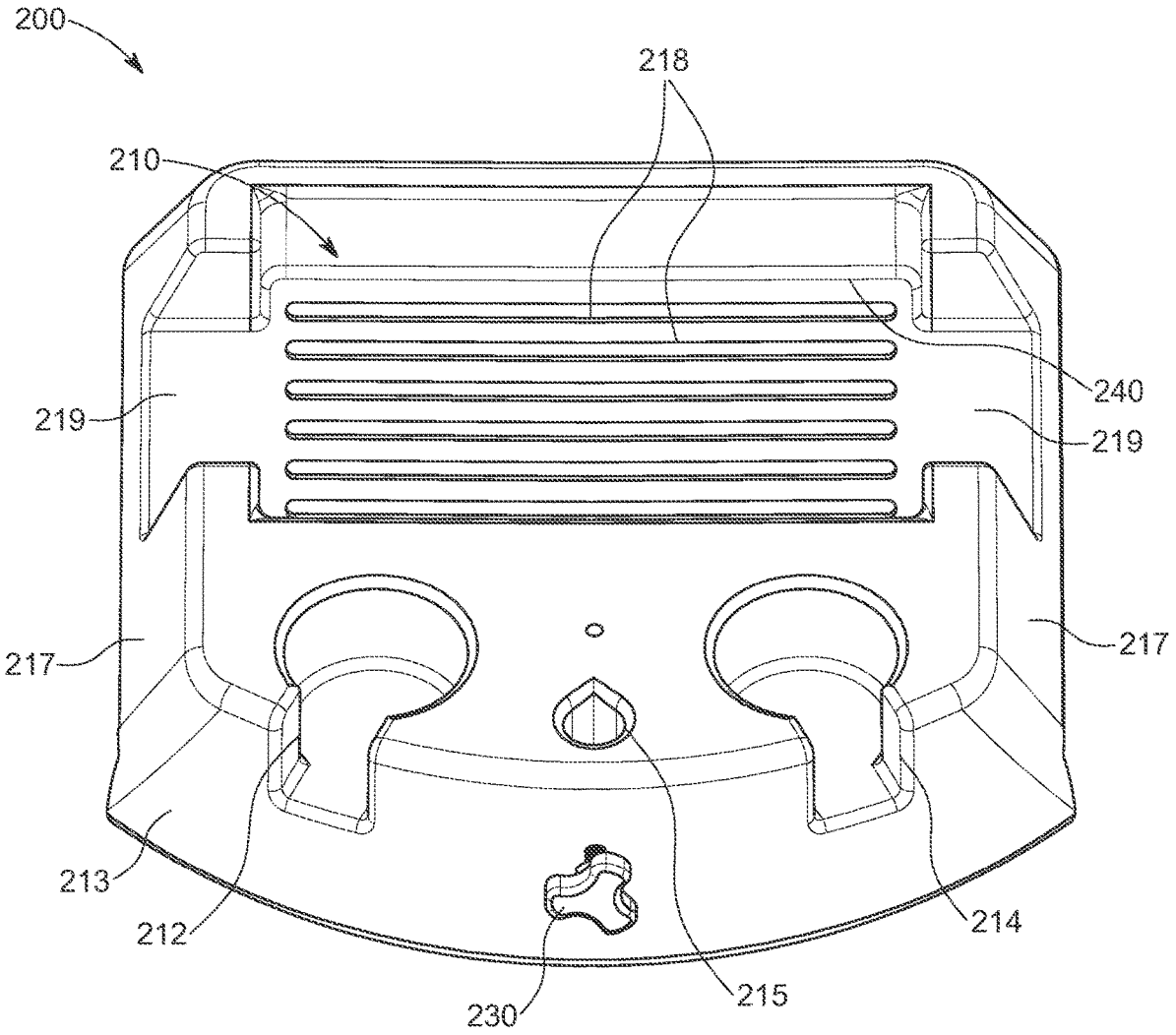

FIG. 6A is an upper front perspective view of a second embodiment stand for supporting beverage containers and a pool umbrella post.

Figure 6B:
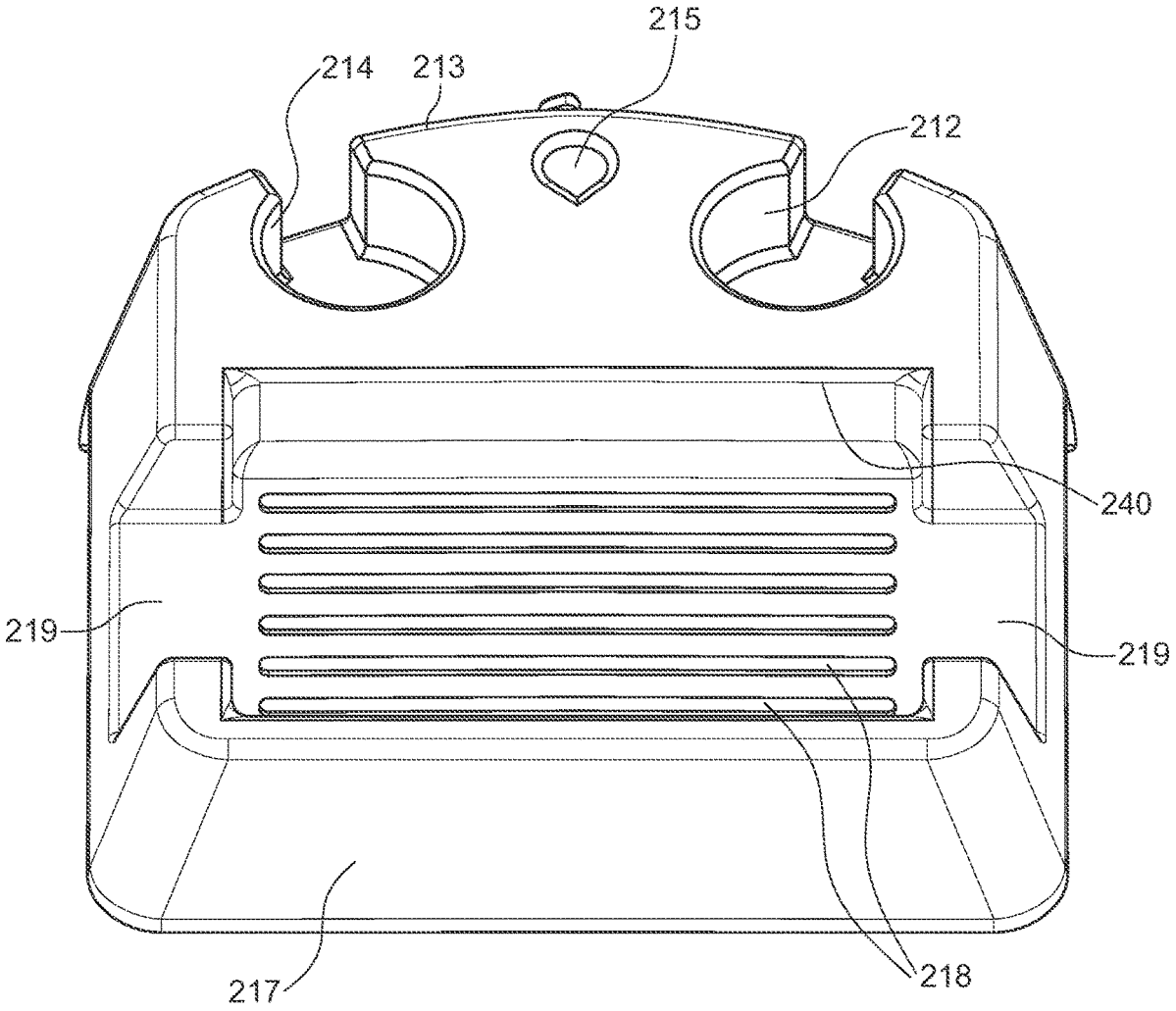

FIG. 6B is an upper rear perspective view of the stand of FIG. 6A.

Figure 6C:
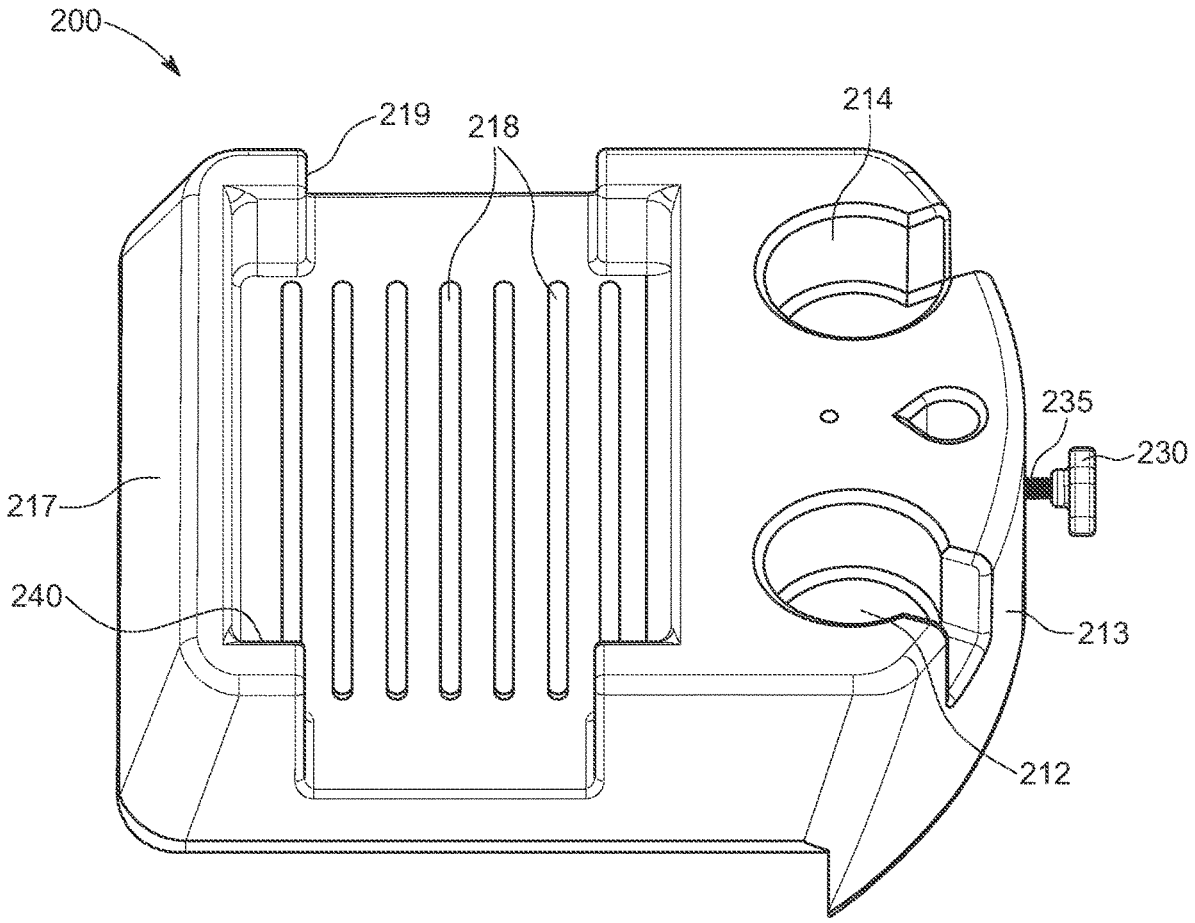

FIG. 6C is an upper left perspective view of the stand of FIG. 6A.

Figure 6D:
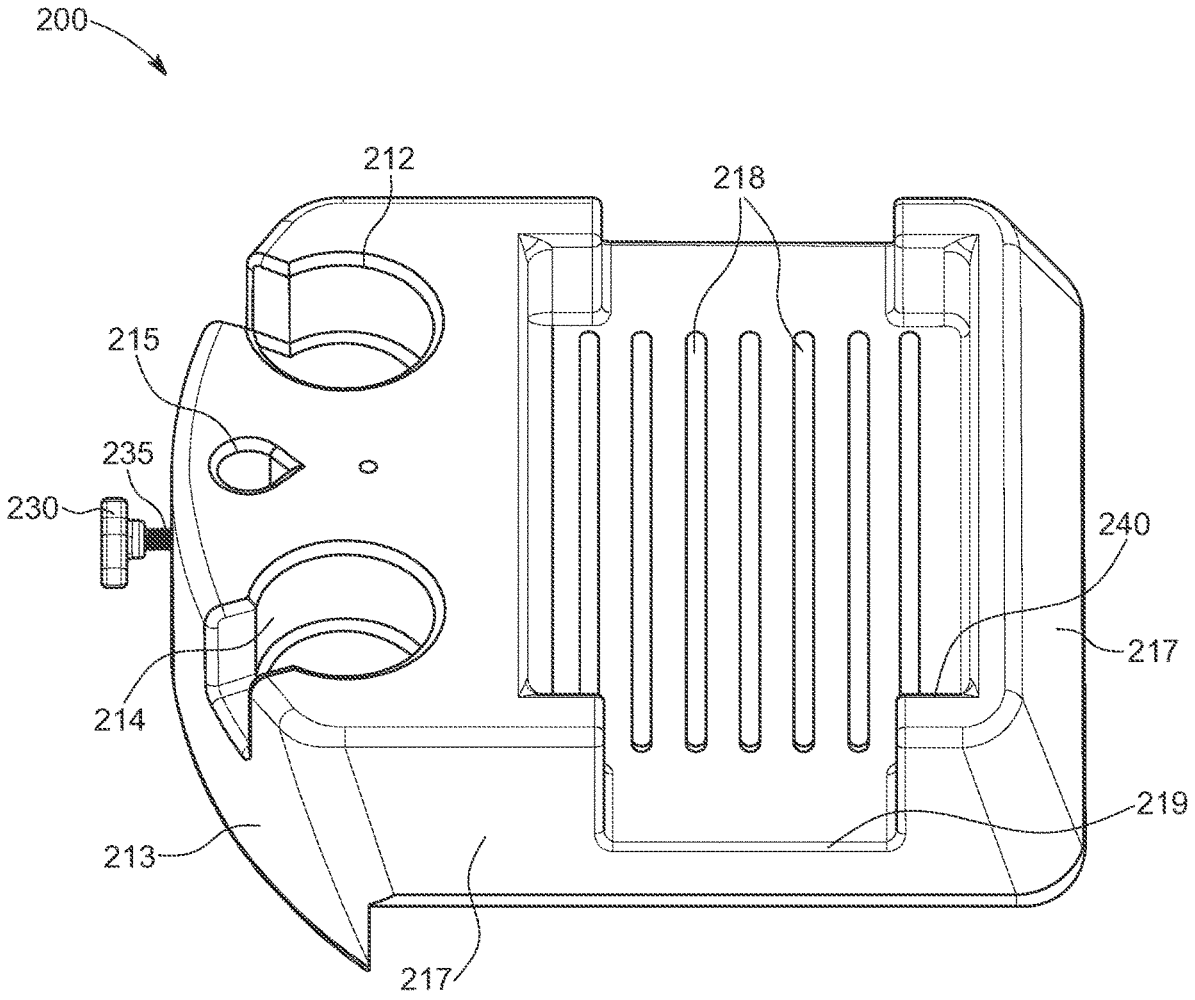

FIG. 6D is an upper right perspective view of the stand of FIG. 6A.

Figure 7A:
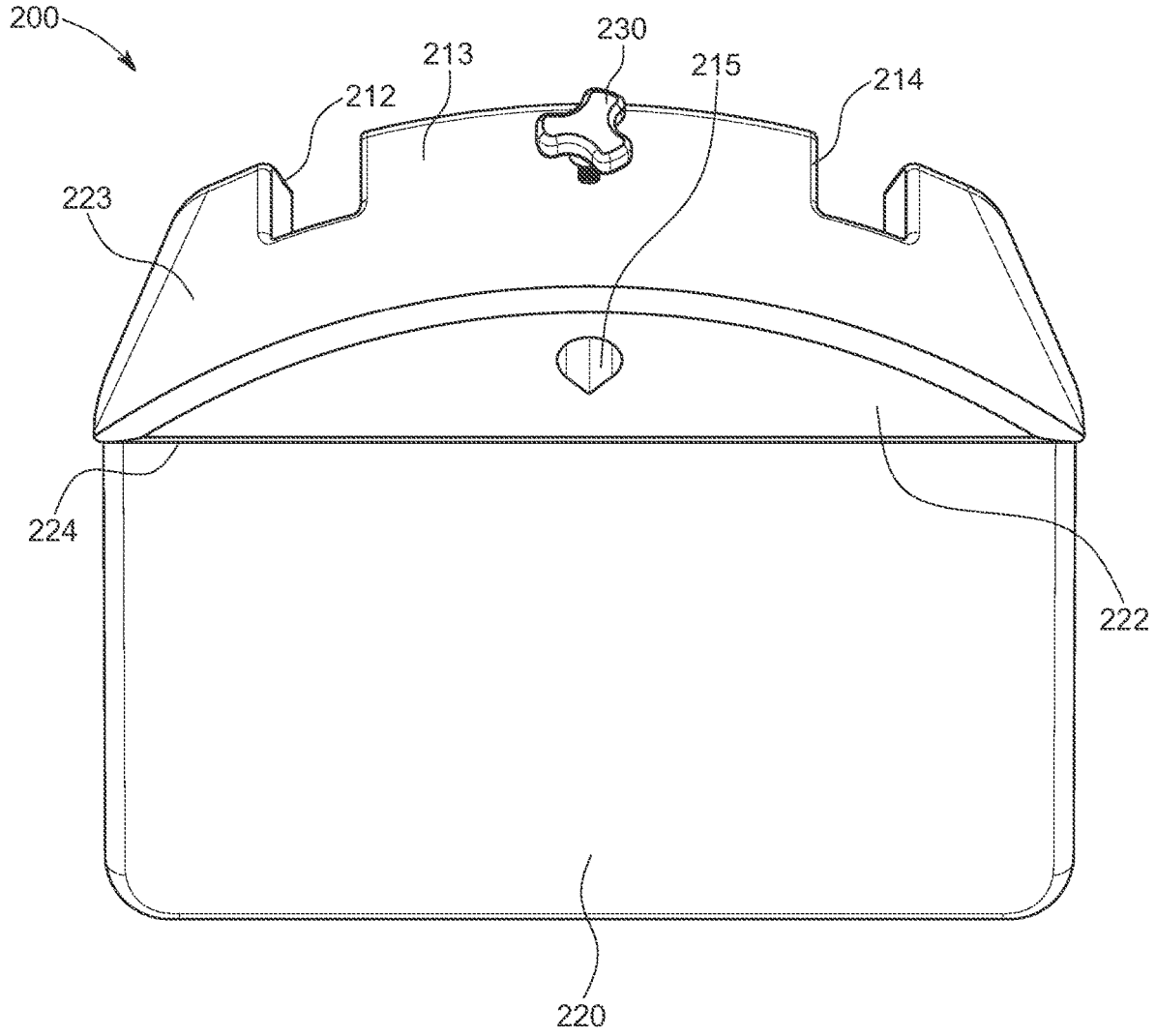

FIG. 7A is a lower front perspective view of the stand of FIG. 6A.

Figure 7B:
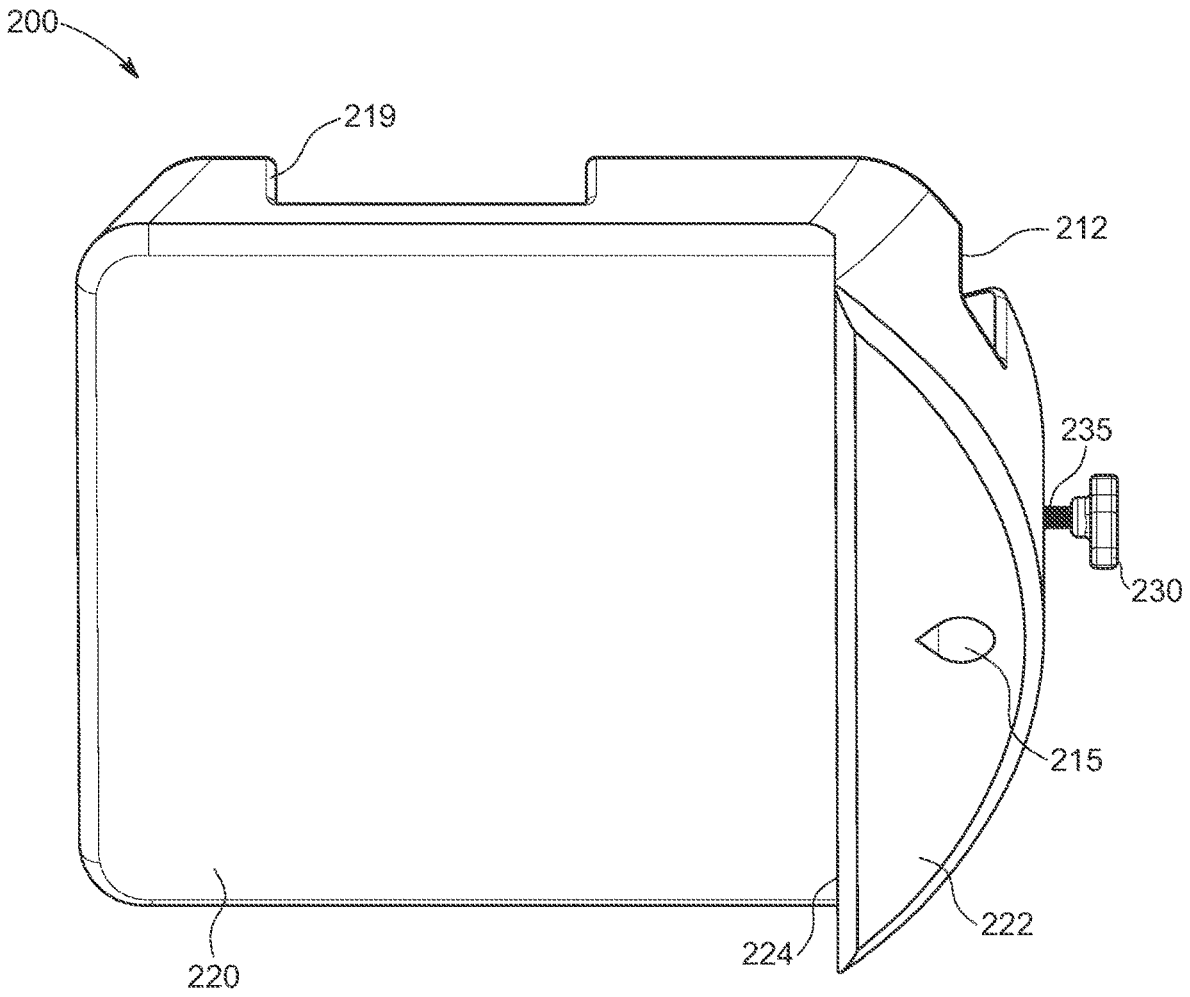

FIG. 7B is a lower left perspective view of the stand of FIG. 6A.

Figure 7C:
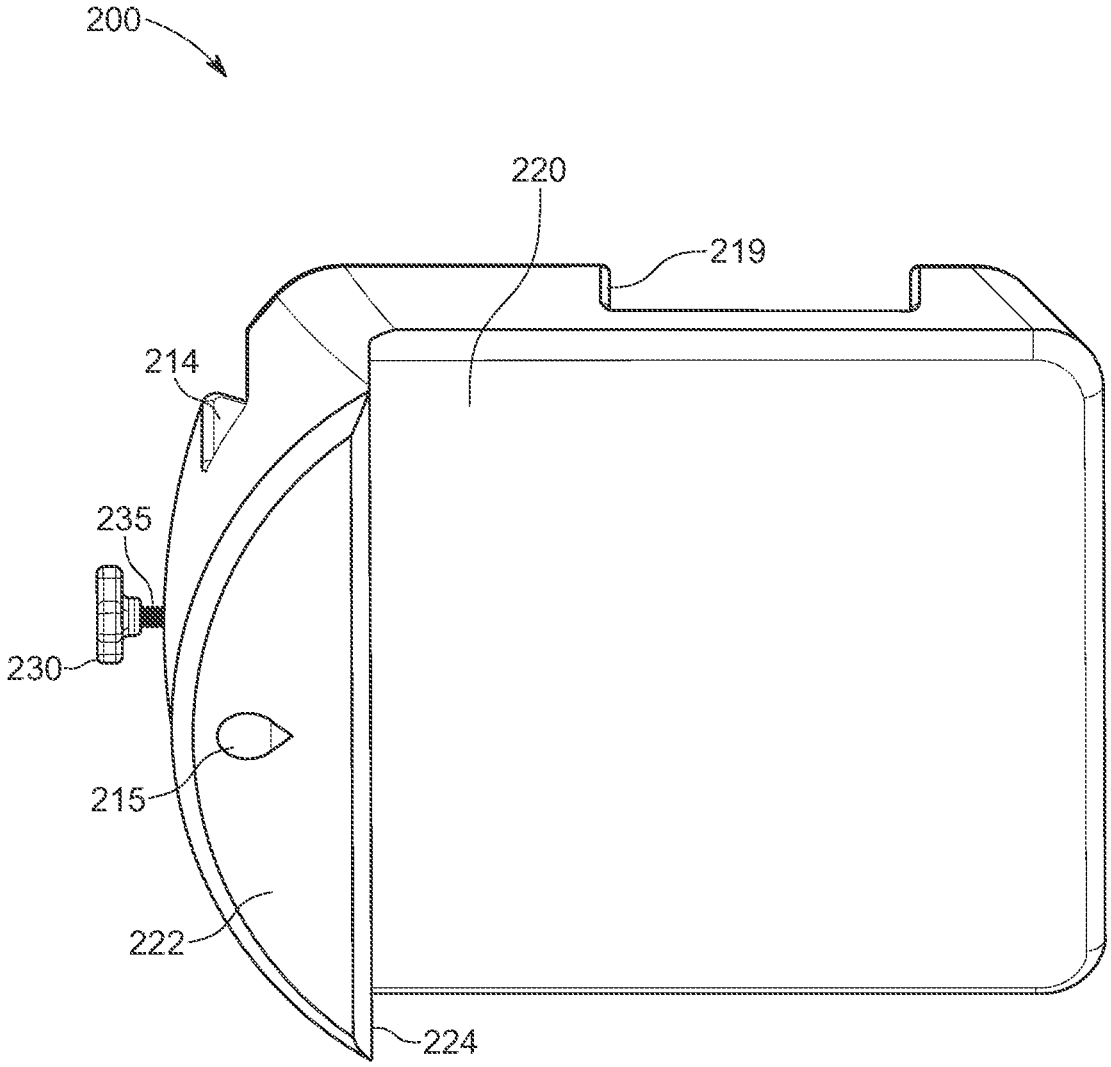

FIG. 7C is a lower right perspective view of the stand of FIG. 6A.

Figure 8A:
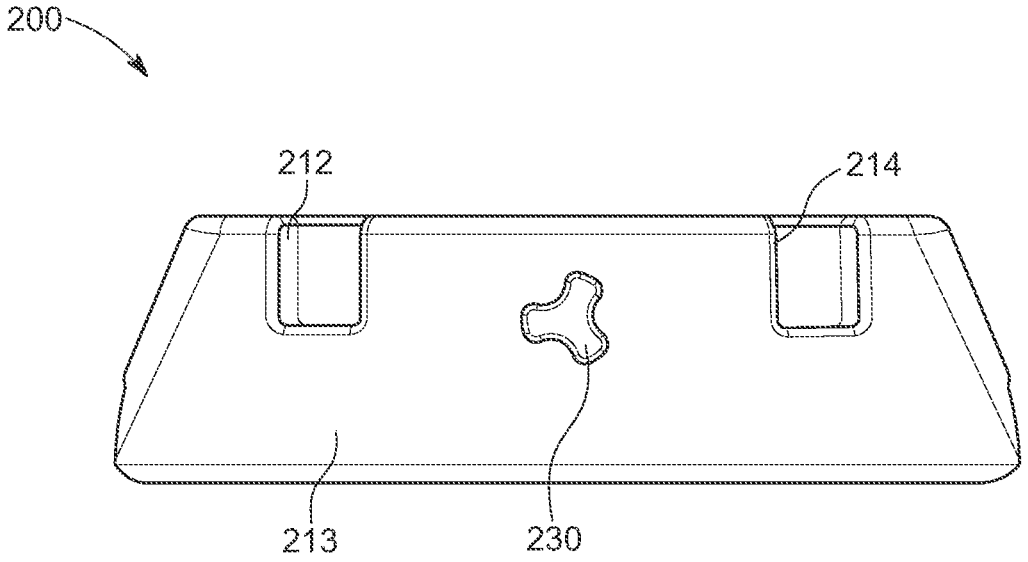

FIG. 8A is a front view of the stand of FIG. 6A.

Figure 8B:
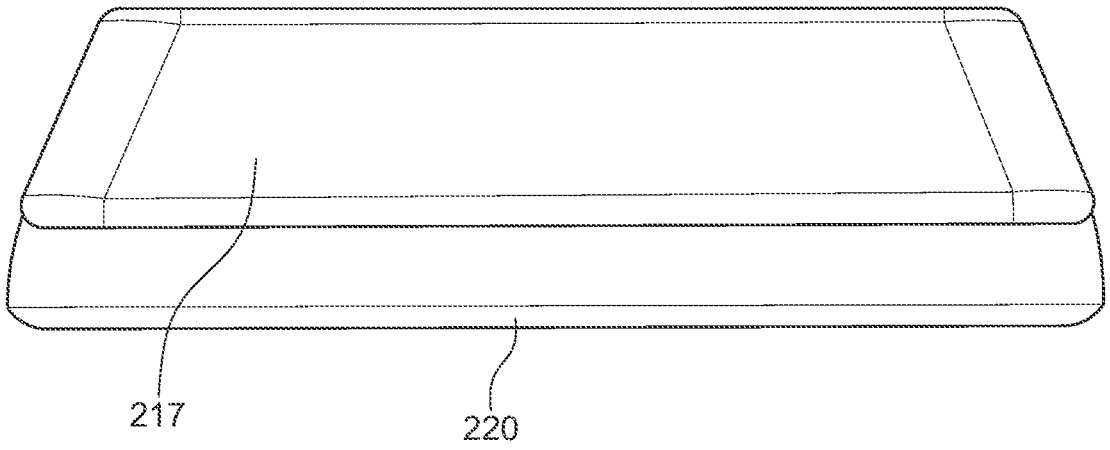

FIG. 8B is a rear view of the stand of FIG. 6A.

Figure 8C:
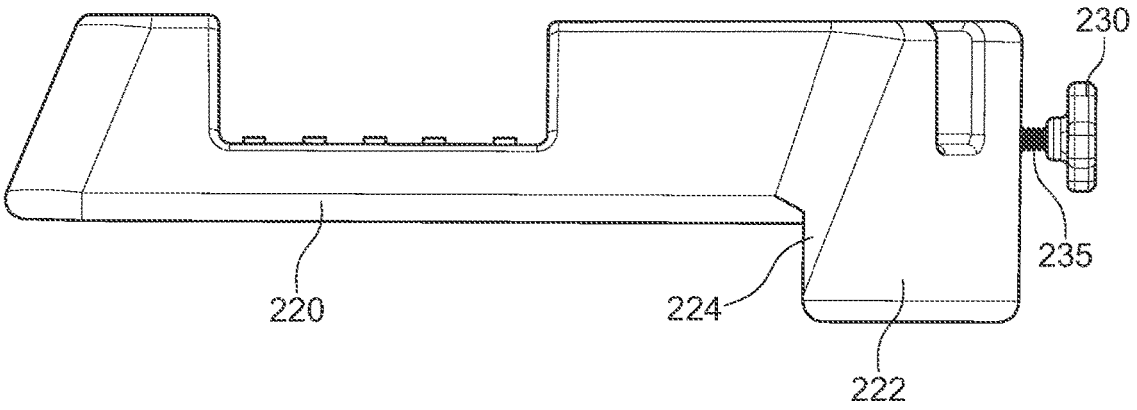

FIG. 8C is a left view of the stand of FIG. 6A.

Figure 8D:
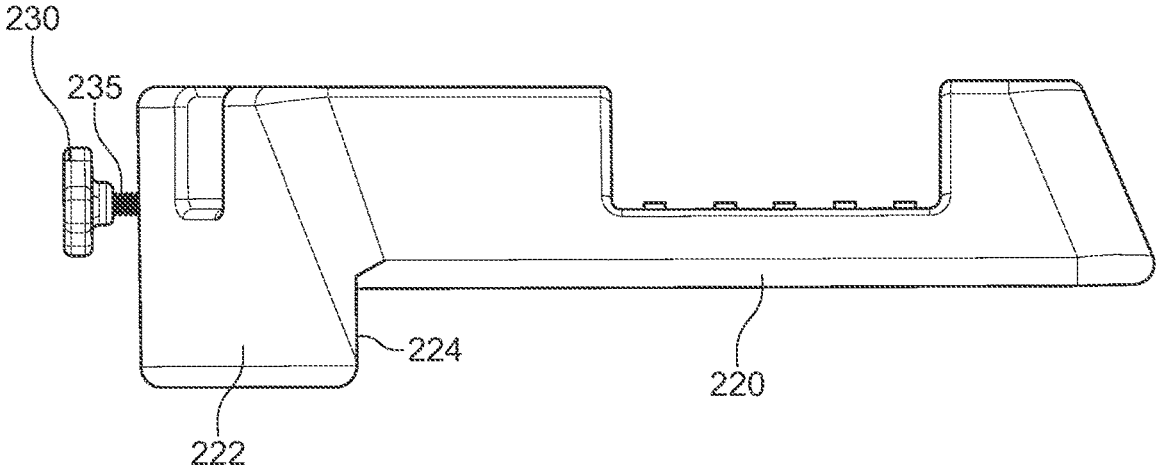

FIG. 8D is a right view of the stand of FIG. 6A.

Figure 9:
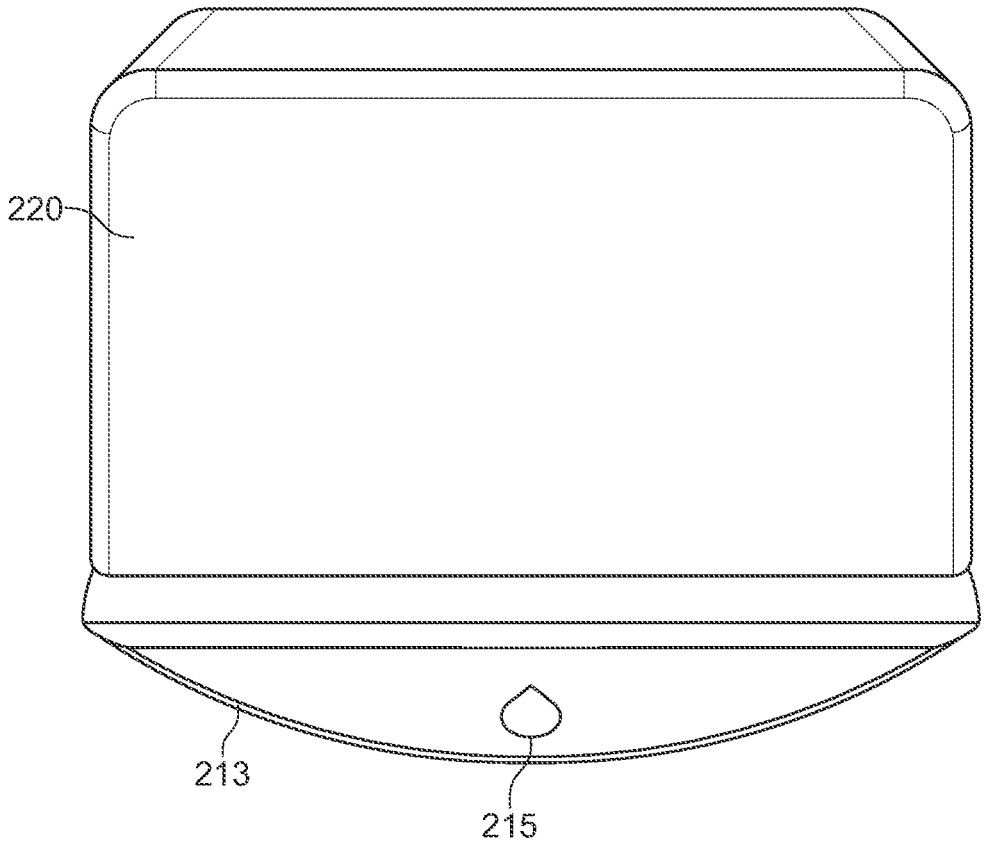

FIG. 9 is a top view of the stand of FIG. 6A.

Figure 10A:
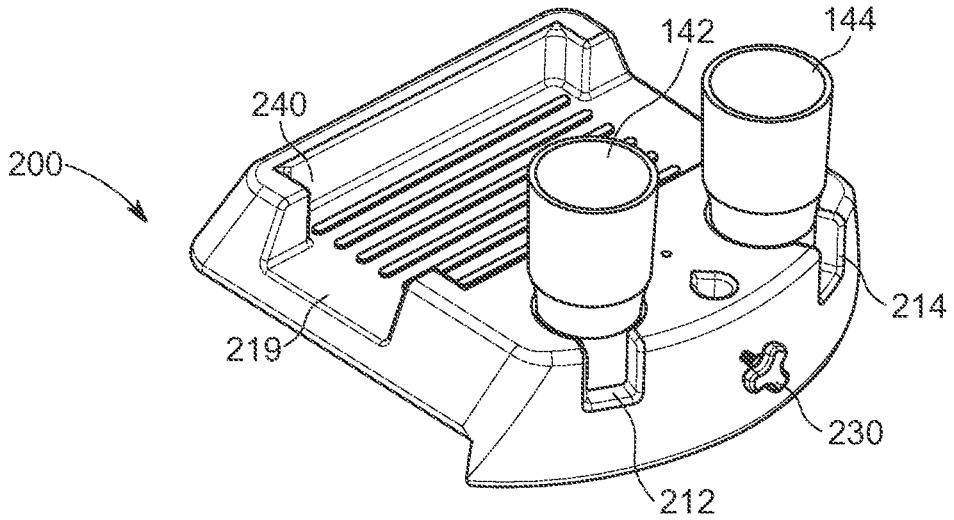

FIG. 10A is an upper front left perspective view of the stand of FIG. 6A supporting two beverage holders.

Figure 10B:
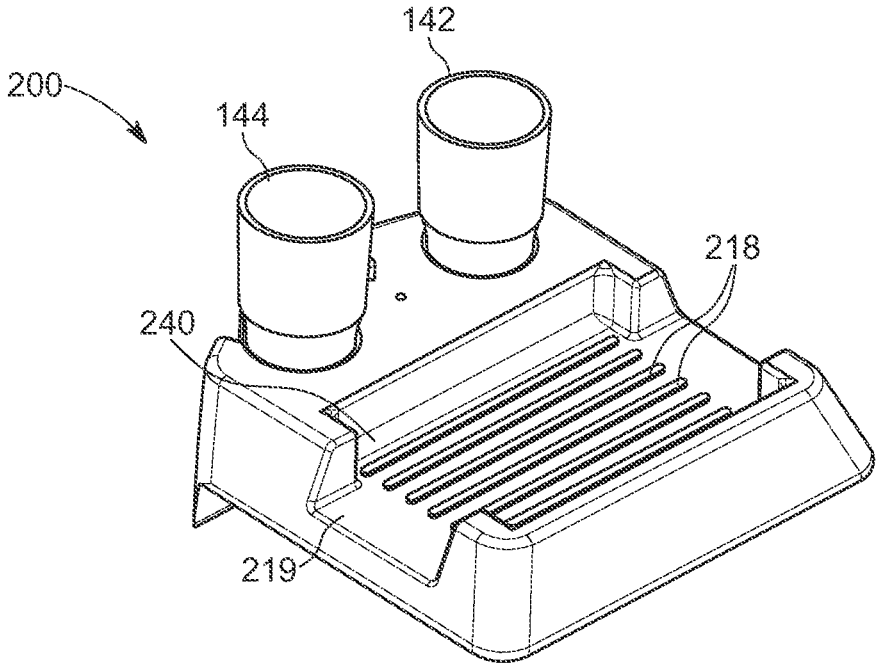

FIG. 10B is an upper rear right perspective view of FIG. 10A.

Figure 11:
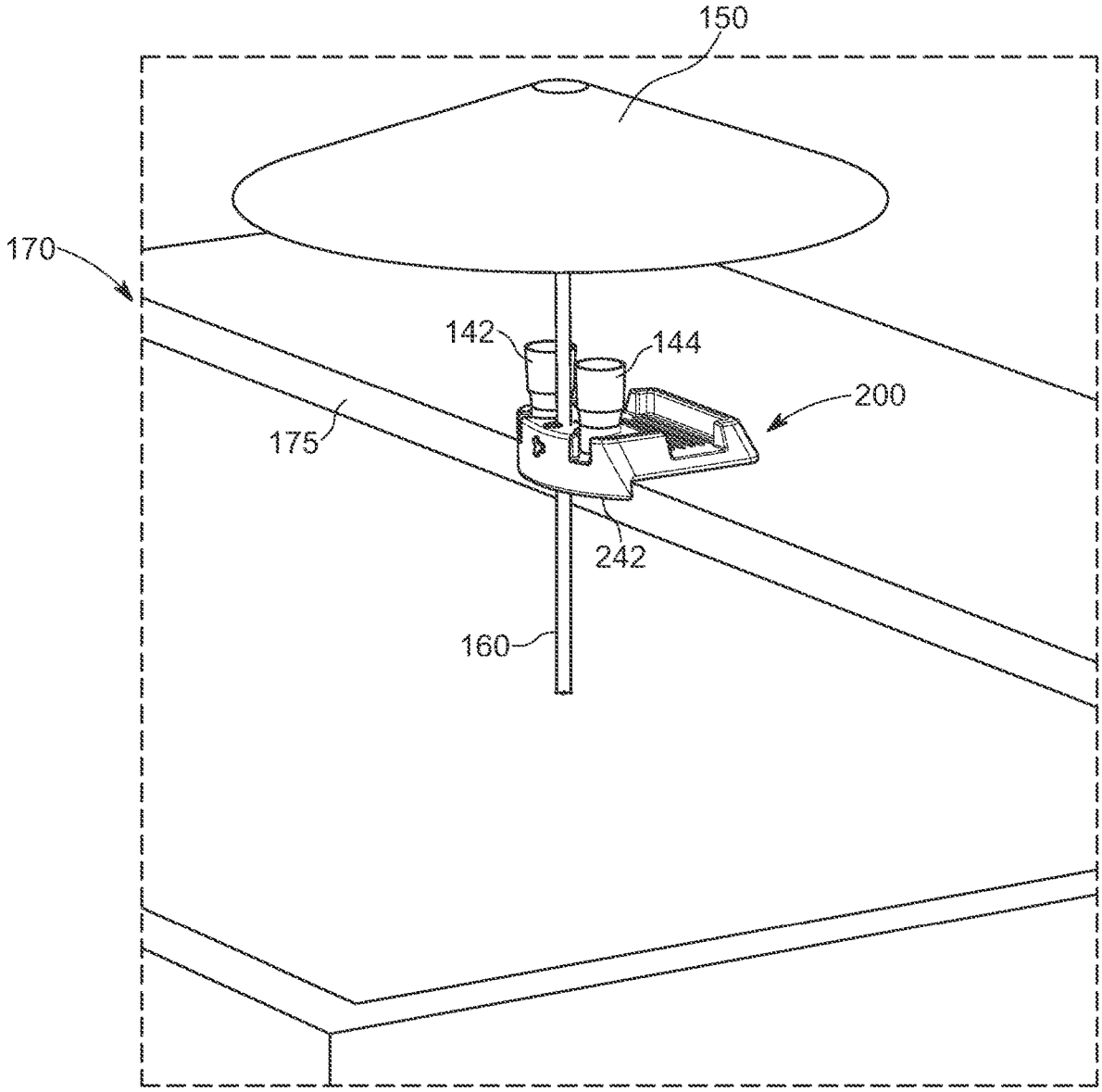

FIG. 11 is a perspective view of the stand with beverage containers of FIGS. 10A-10B supported on an edge of a swimming pool with an umbrella post clamped to the stand.

Improvement Starts Here

Figure 12A:
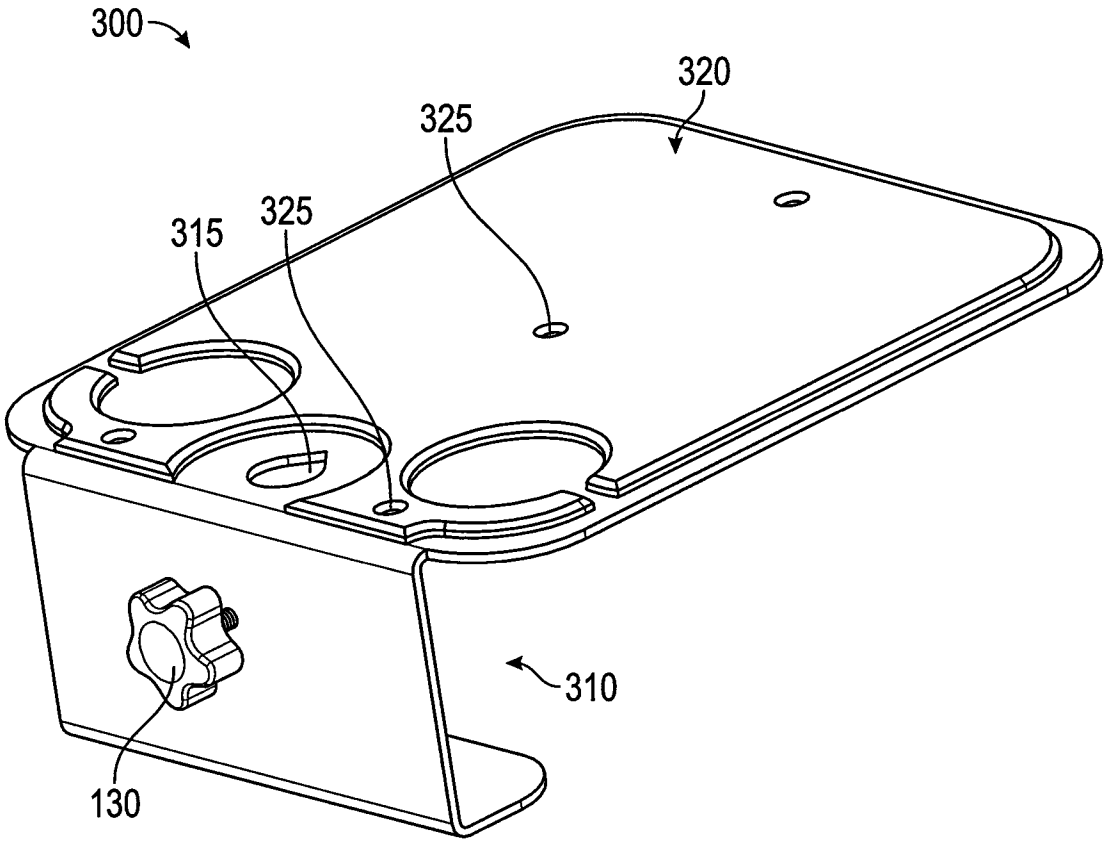

FIG. 12A is a perspective view of a third embodiment stand for supporting beverage containers and a pool umbrella post, formed from a metal panel.

Figure 12B:
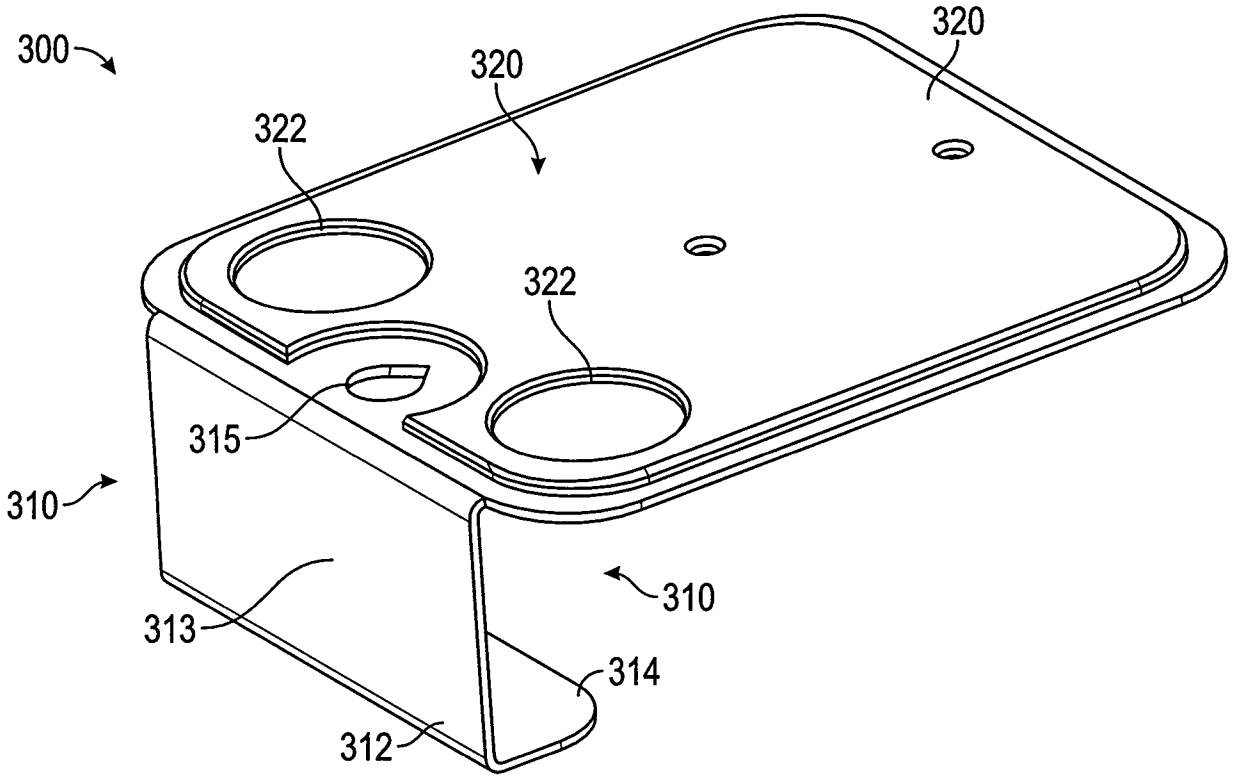

FIG. 12B is another perspective view of the stand of FIG. 12A without the clamping screw/knob.

Figure 13A:
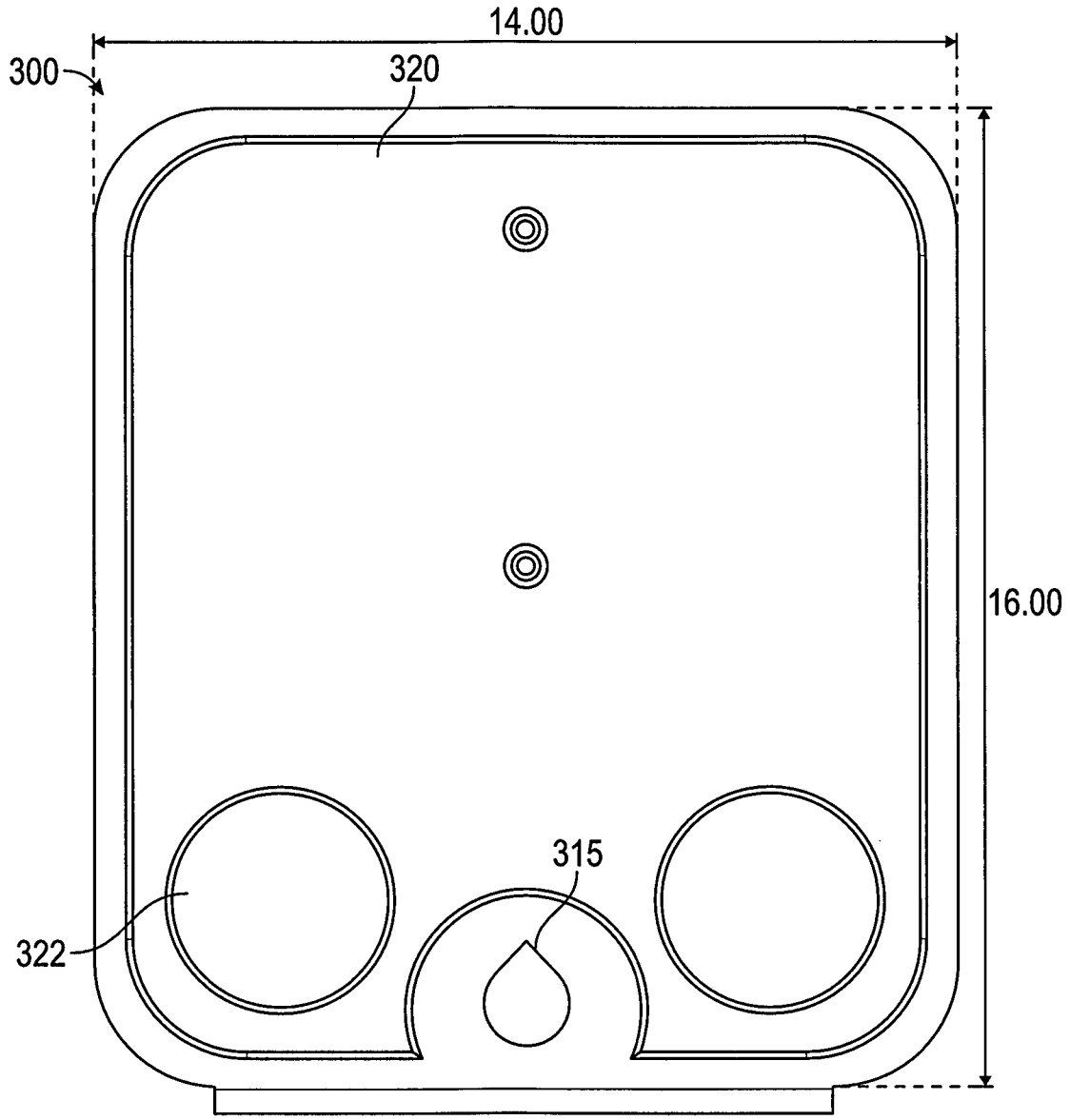

FIG. 13A is a top view of the stand of FIGS. 12A-12B.

Figure 13B:
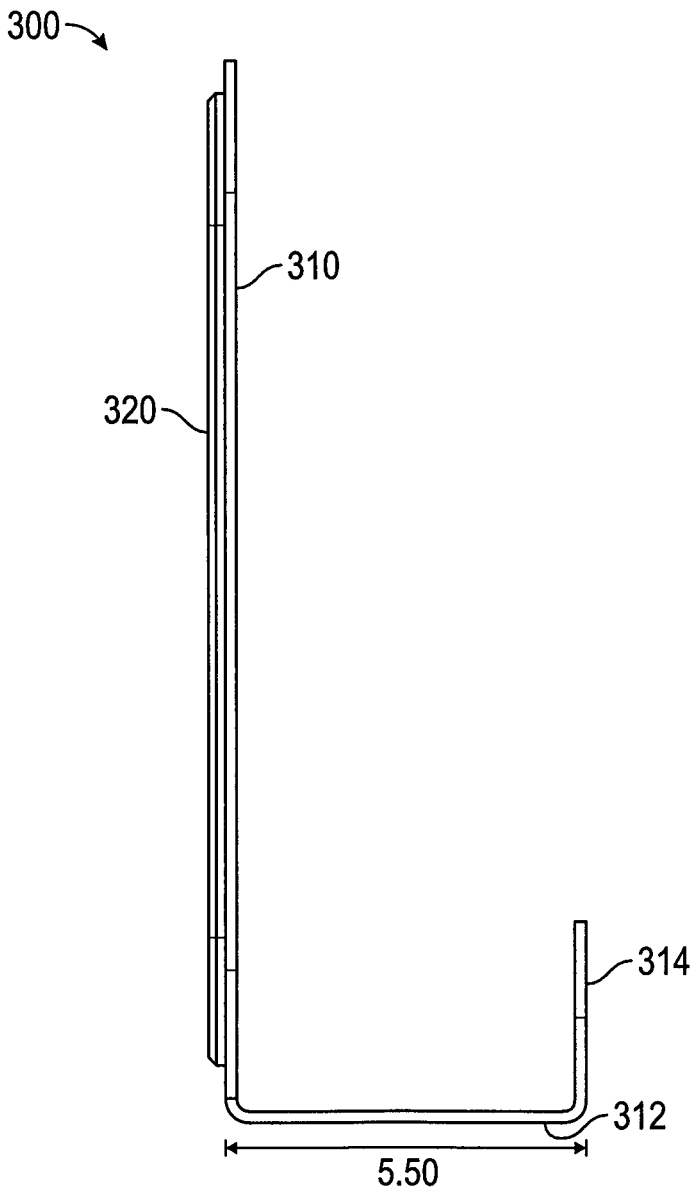

FIG. 13B is a side view of the stand of FIGS. 12A-12B.

Figure 14A:
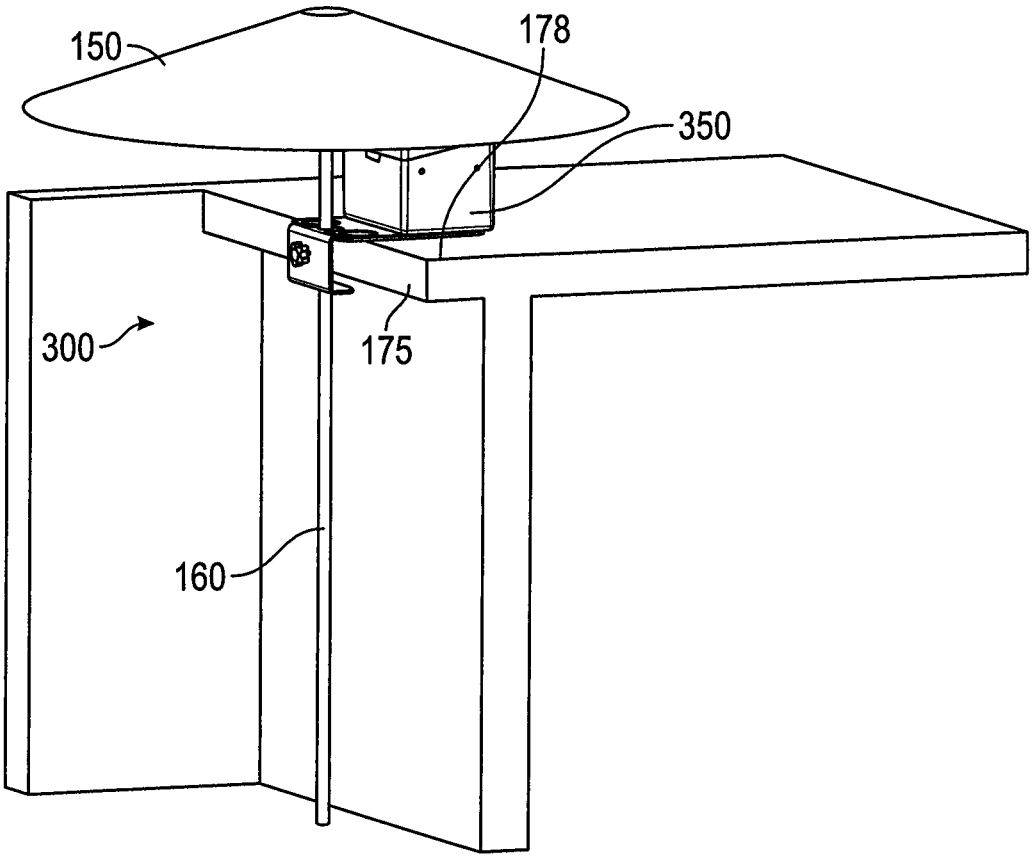

FIG. 14A is a perspective view of the stand of FIGS. 12A-13B about an edge of a swimming pool with an umbrella post clamped to the stand and a cooler as ballast for the stand.

Figure 14B:
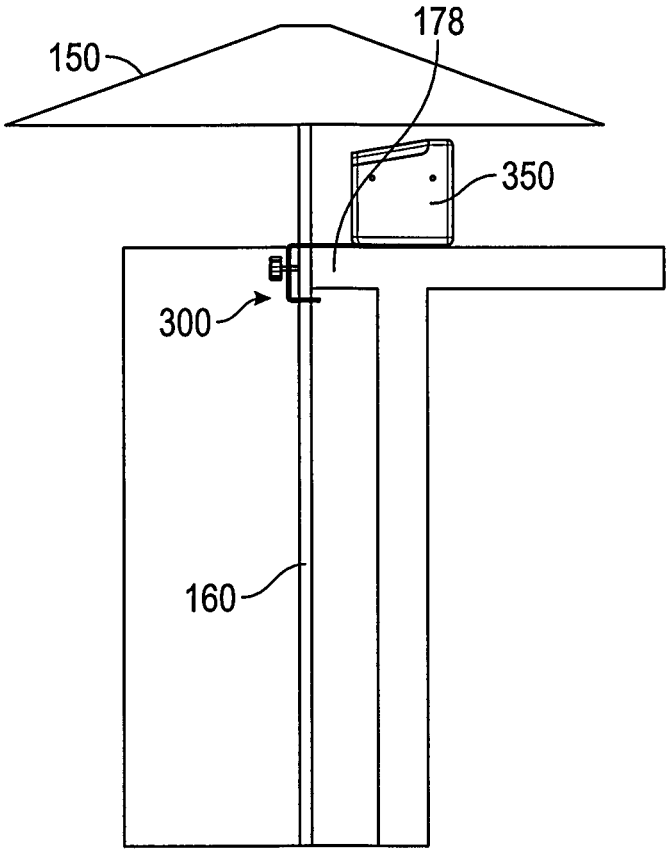

FIG. 14B is a side view of FIG. 14B.

Figure 15A:
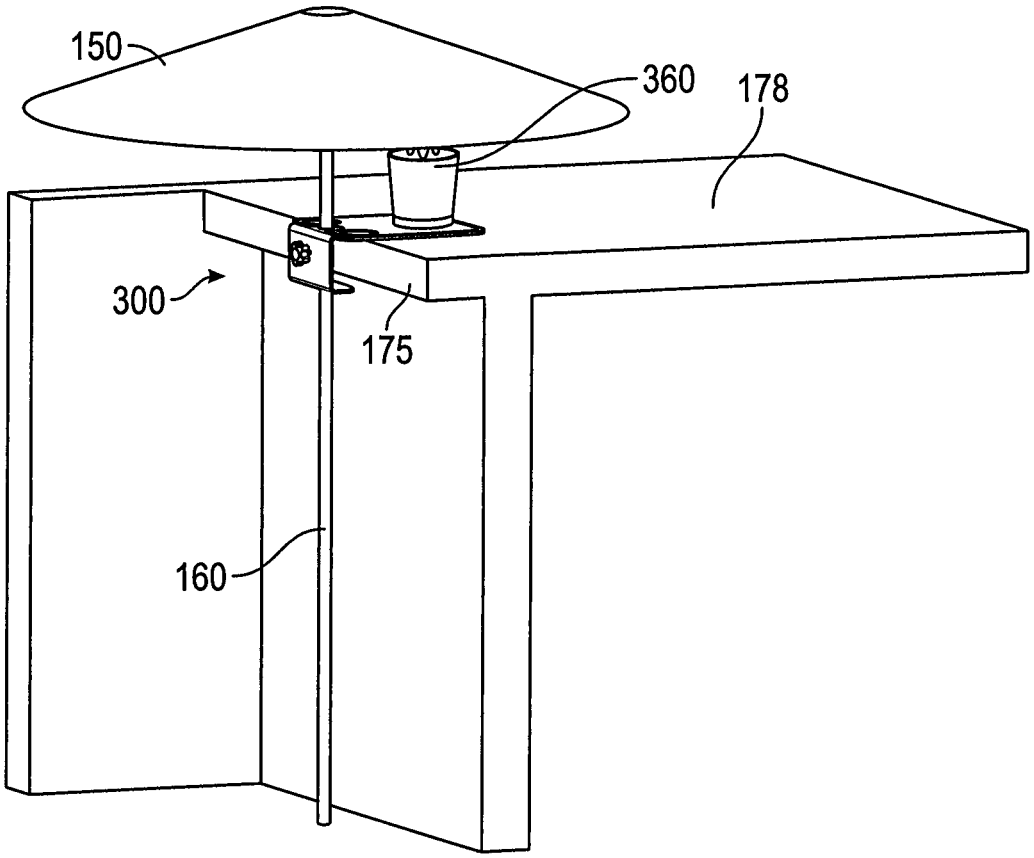

FIG. 15A is a perspective view of the stand of FIGS. 12A-13B about an edge of a swimming pool with an umbrella post clamped to the stand and a potted plant as ballast for the stand.

Figure 15B:
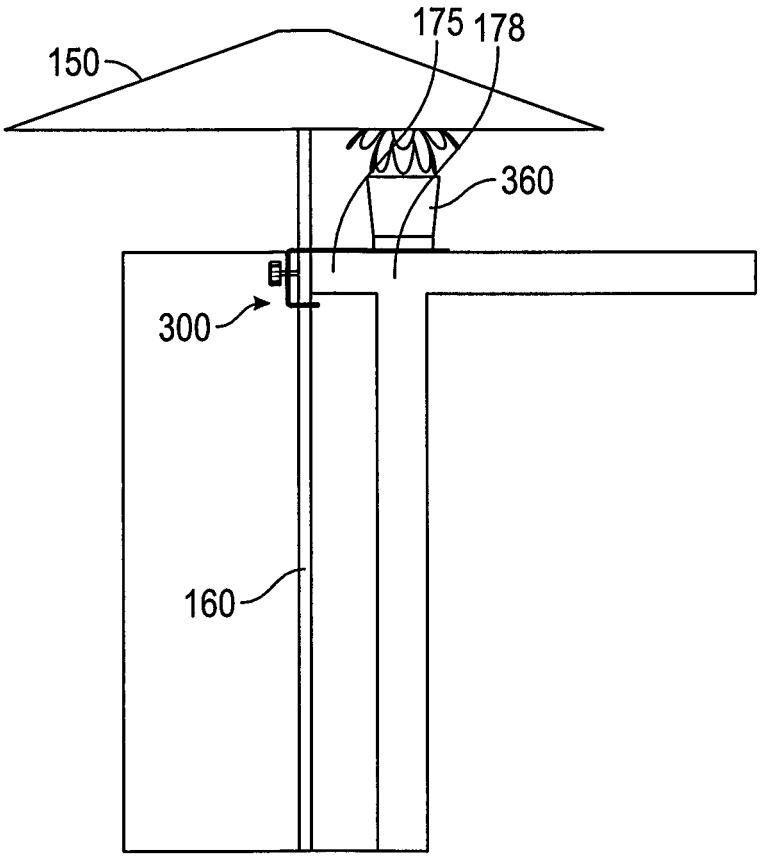

FIG. 15B is a side view of FIG. 15A.

Figure 16A:
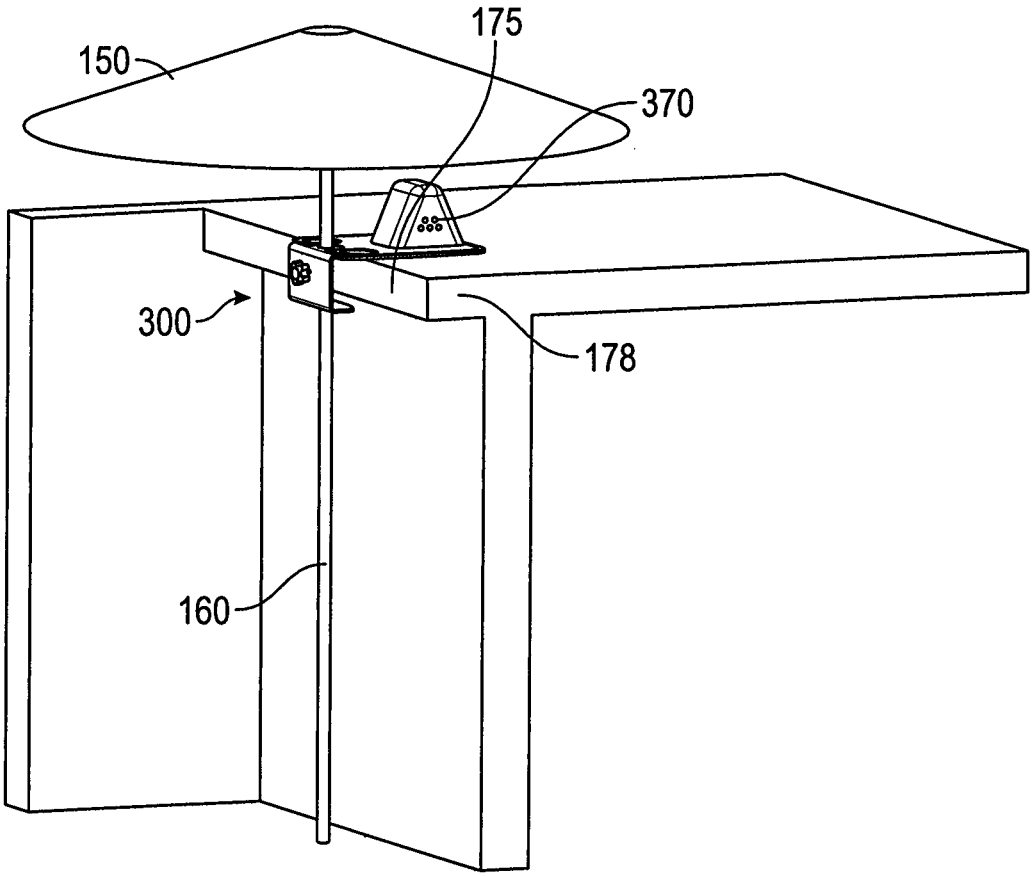

FIG. 16A is a perspective view of the stand of FIGS. 12A-13B about an edge of a swimming pool with an umbrella post clamped to the stand with a 35 pound weight as ballast for the stand.

Figure 16B:
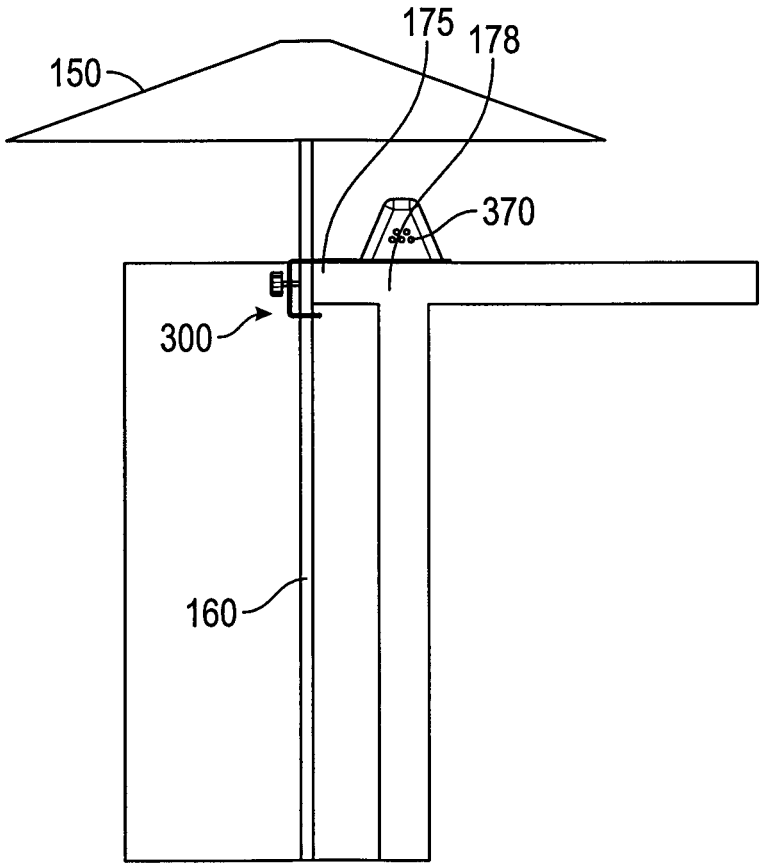

FIG. 16B is a side view of FIG. 16A.

Figure 17A:
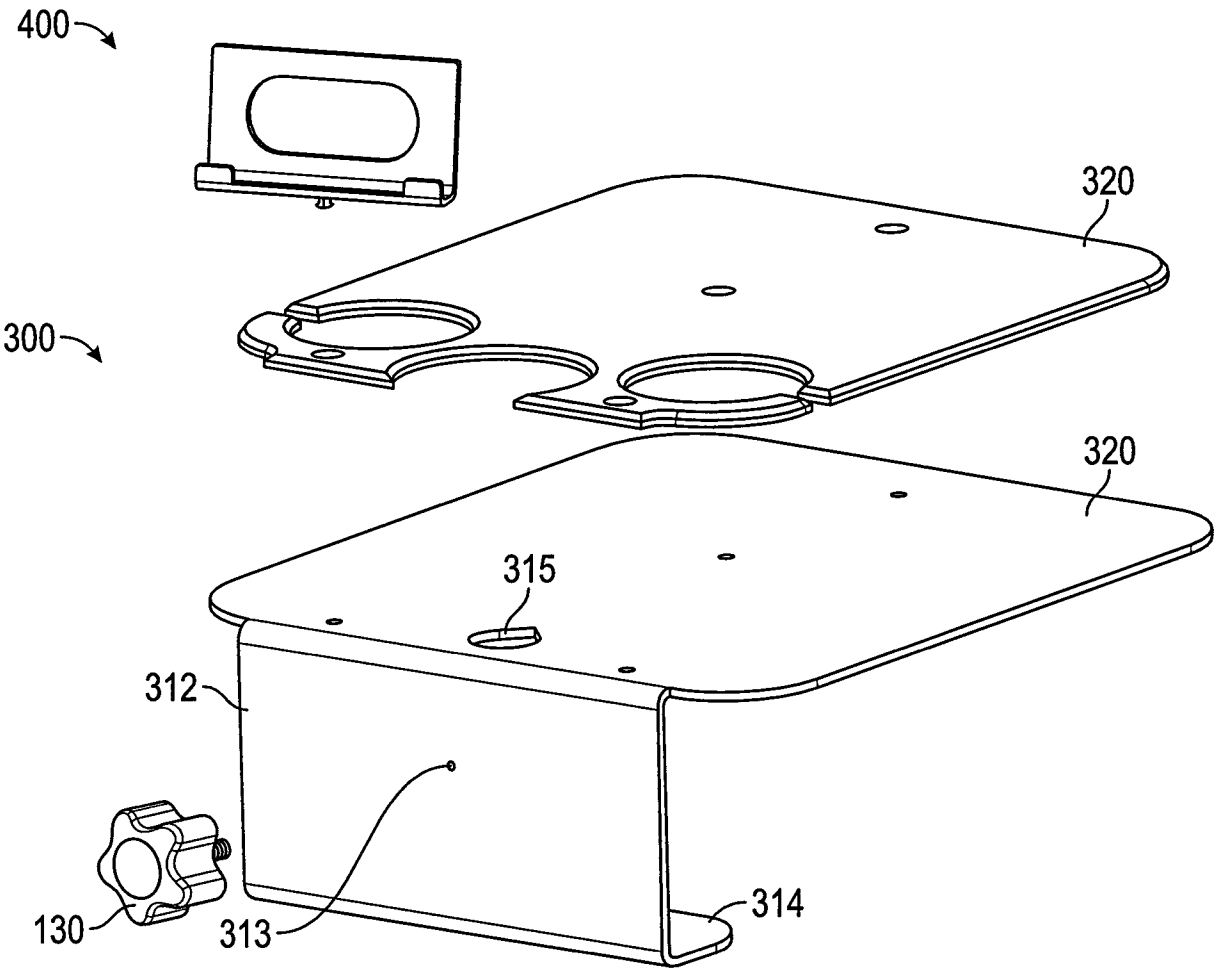

FIG. 17A is a perspective exploded view of the stand of FIGS. 12A-13B along with an optional portable phone holder.

Figure 17B:
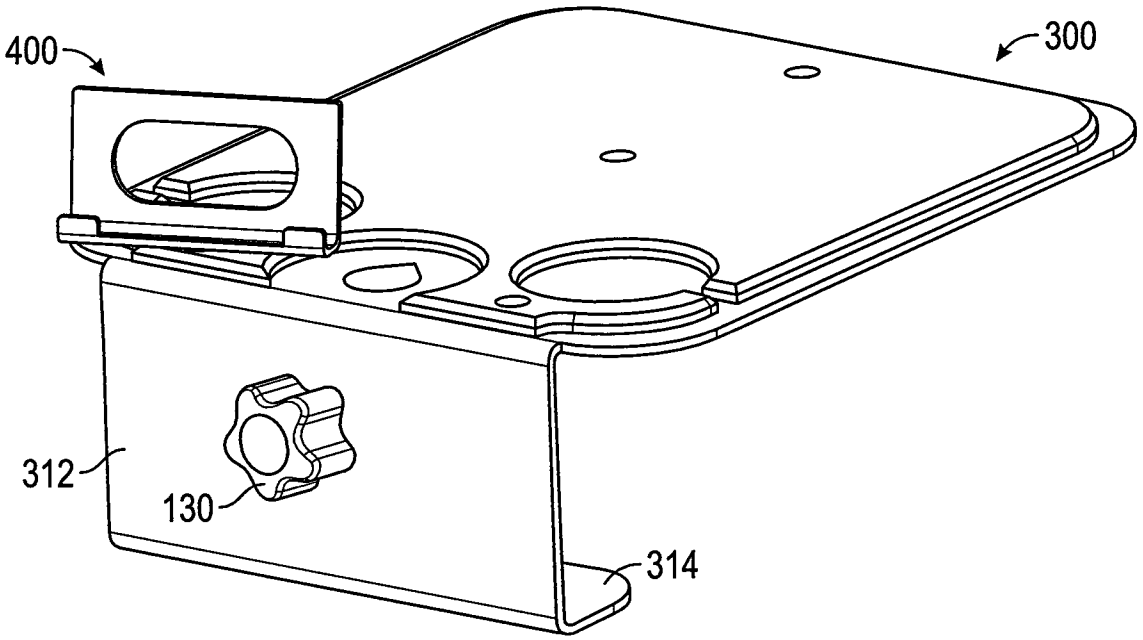

FIG. 17B is a perspective assembled view of the stand in FIG. 17A.

Figure 18A:
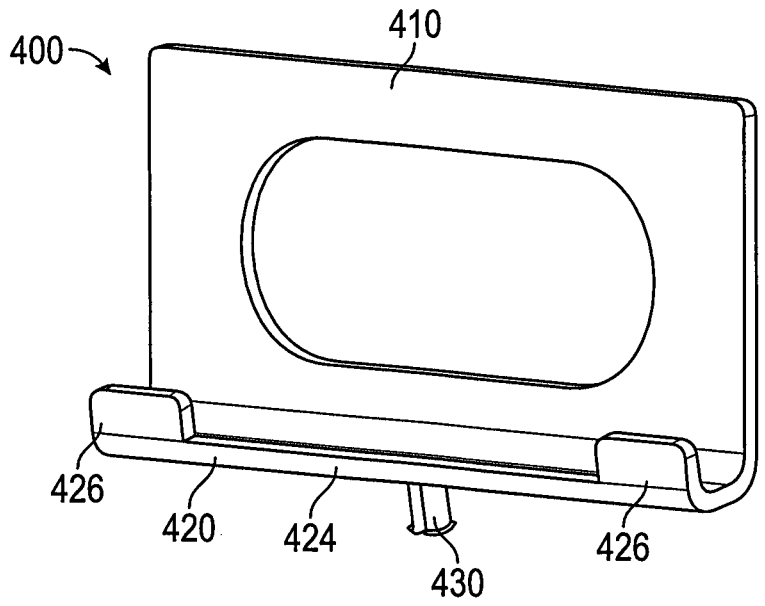

FIG. 18A is a perspective view of the portable phone holder shown in FIGS. 17A-17B.

Figure 18B:
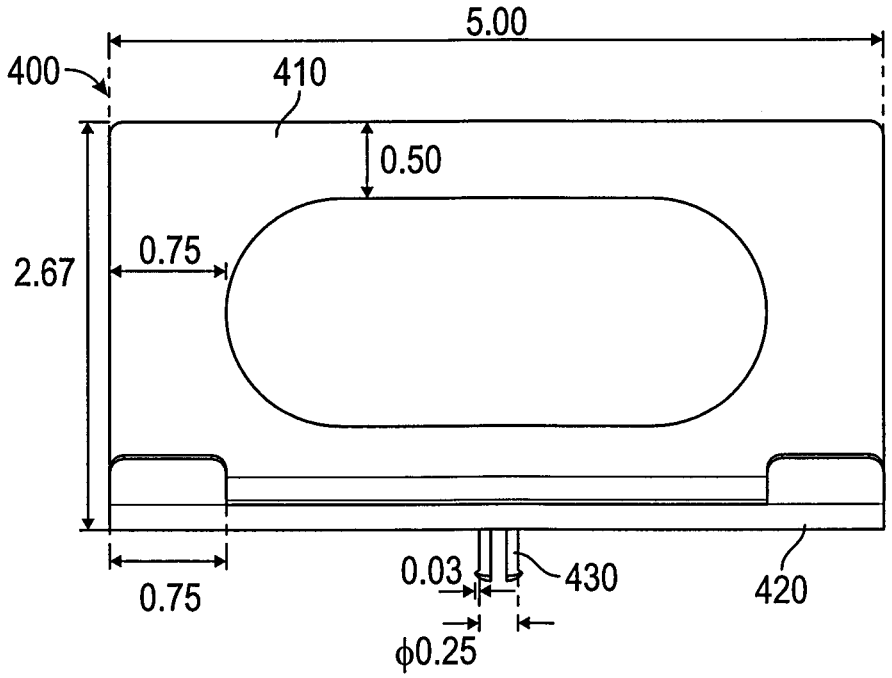

FIG. 18B is a front view of the portable phone holder of FIG. 18A.

Figure 18C:
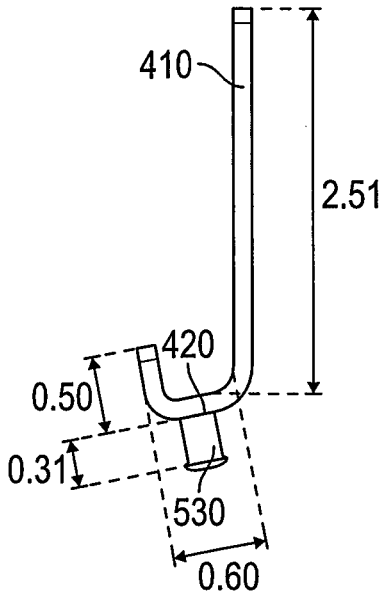

FIG. 18C is a side view of the portable phone holder of FIG. 18A.

DESCRIPTION OF THE PREFERRED EMBODIMENTS

Before explaining the disclosed embodiments of the present invention in detail it is to be understood that the invention is not limited in its applications to the details of the particular arrangements shown since the invention is capable of other embodiments. Also, the terminology used herein is for the purpose of description and not of limitation.

In the Summary above and in the Detailed Description of Preferred Embodiments and in the accompanying drawings, reference is made to particular features (including method steps) of the invention. It is to be understood that the disclosure of the invention in this specification does not include all possible combinations of such particular features. For example, where a particular feature is disclosed in the context of a particular aspect or embodiment of the invention, that feature can also be used, to the extent possible, in combination with and/or in the context of other particular aspects and embodiments of the invention, and in the invention generally.

In this section, some embodiments of the invention will be described more fully with reference to the accompanying drawings, in which preferred embodiments of the invention are shown. This invention may, however, be embodied in many different forms and should not be construed as limited to the embodiments set forth herein. Rather, these embodiments are provided so that this disclosure will be thorough and complete, and will convey the scope of the invention to those skilled in the art. Like numbers refer to like elements throughout, and prime notation is used to indicate similar elements in alternative embodiments.

Other technical advantages may become readily apparent to one of ordinary skill in the art after review of the following figures and description.

It should be understood at the outset that, although exemplary embodiments are illustrated in the figures and described below, the principles of the present disclosure may be implemented using any number of techniques, whether currently known or not. The present disclosure should in no way be limited to the exemplary implementations and techniques illustrated in the drawings and described below.

Unless otherwise specifically noted, articles depicted in the drawings are not necessarily drawn to scale.

A list of components will now be described.

100 First embodiment circular disc stand for supporting beverage holders and pool umbrella post
105 fill cap
110 upper disc member
112 front left indentation for beverage holder
113 rounded edge
114 right indentation of beverage holder
115 through-hole for umbrella post
116 raised rim edge
118 raised ridges
120 lower disc member
122 front step member
123 rounded front edge
124 rear step edge
125 through-hole for umbrella post
130 clamping screw/knob
135 threaded stem member
142 left beverage holder
144 right beverage holder
150 umbrella with canopy
160 umbrella post
170 swimming pool
175 inner edge of swimming pool
178 pool coping
200 Second embodiment rectangular stand for supporting beverage holders and pool umbrella post
210 top
212 front left indentation for beverage holder
213 rounded front edge
214 right tops indentation of beverage holder
215 through-hole for umbrella post
217 flat angled sides
218 raised ridges
219 opposite facing cut outs
220 flat bottom
222 front step member
223 rounded front edge
224 rear step edge
225 through-hole for umbrella post
230 clamping screw/knob
235 threaded stem member
240 rectangular well
300 third embodiment metal plate stand with bent edge for supporting beverage holders and pool umbrella post
310 metal plate
311 front
312 downward vertical bent portion
313 horizontal through-hole
314 inward bent step portion
315 through-hole for umbrella post
318 rear
320 nonmetal layer
322 cylindrical indentation(s)
325 accessory mount through-hole(s)
340 portable phone
350 cooler
360 planter (pot)
370 35 lb weight
400 portable phone holder
410 back plate
420 ledge
424 upward bent edge
426 ledge tip(s)
430 post for holder

First Embodiment Circular Stand

Figure 1A:
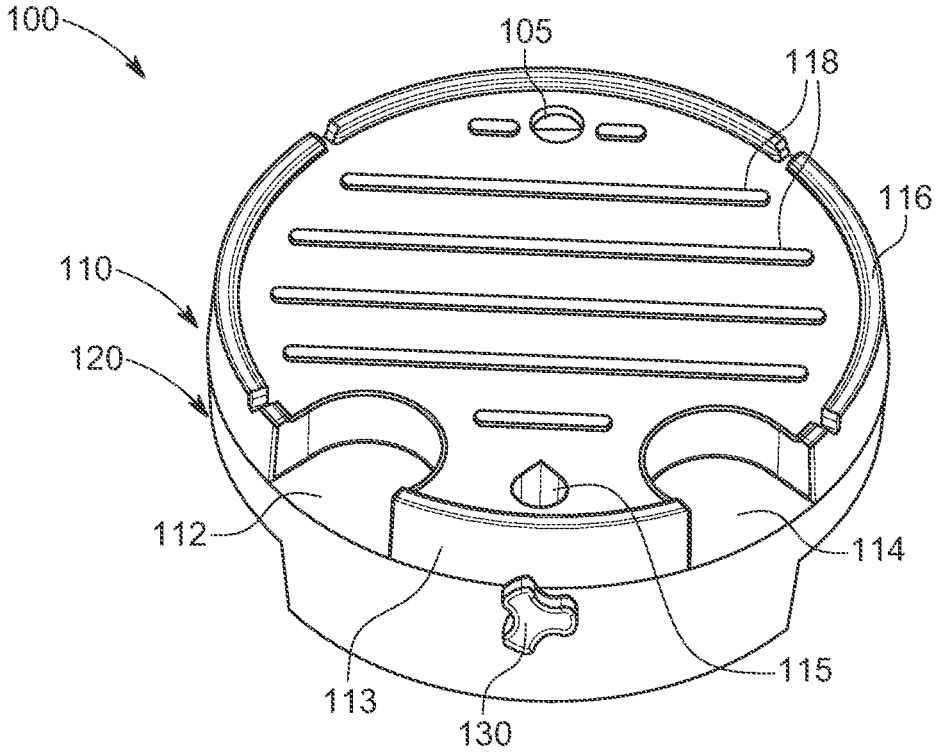
FIG. 1A is an upper front perspective view of a first embodiment stand for supporting beverage containers and a pool umbrella post
Figure 1B:
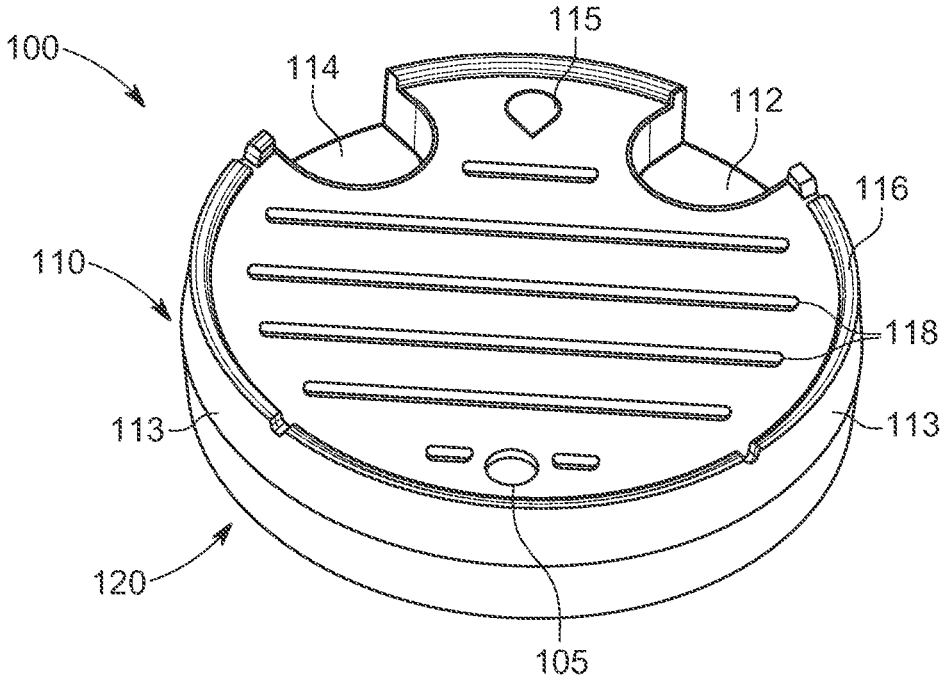
FIG. 1B is an upper rear perspective view of the stand of FIG. 1A.
Figure 1C:
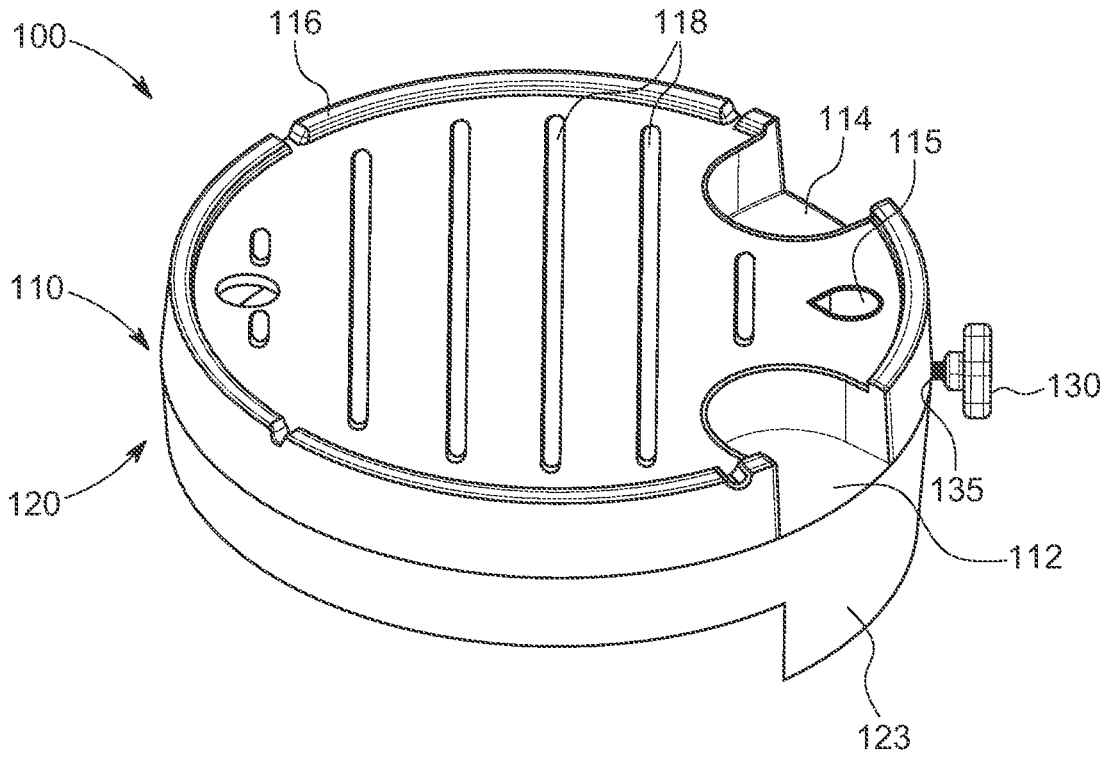
FIG. 1C is an upper left perspective view of the stand of FIG. 1A.
Figure 1D:
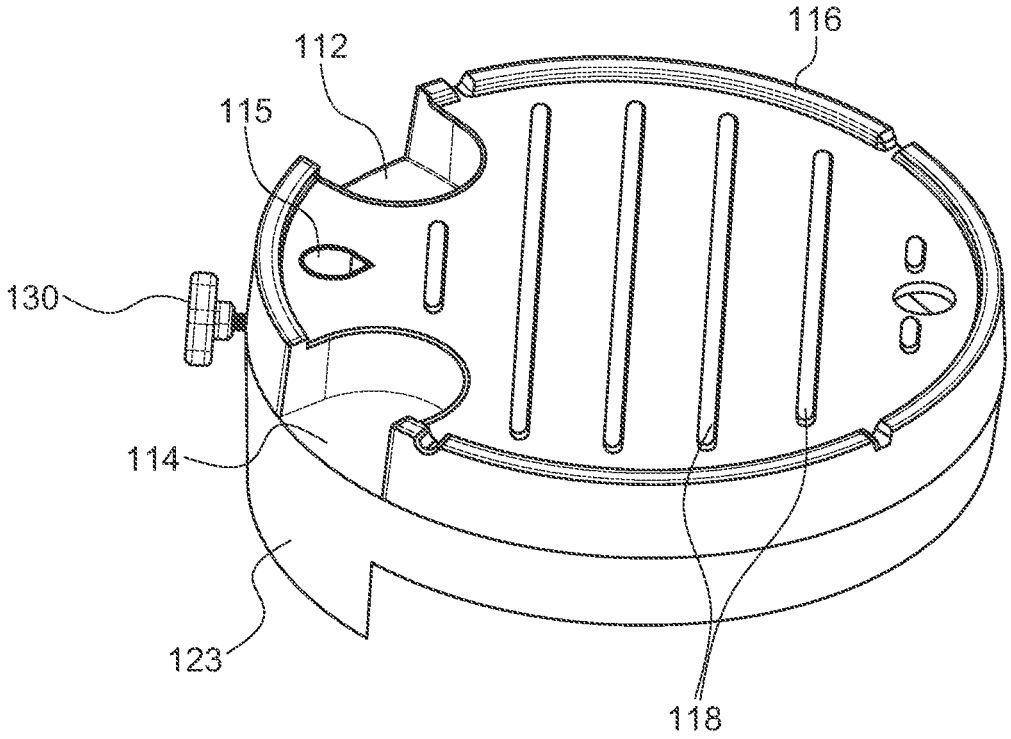
FIG. 1D is an upper right perspective view of the stand of FIG. 1A.

FIG. 1A is an upper front perspective view of a first embodiment stand 100 for supporting beverage containers and a pool umbrella post. FIG. 1B is an upper rear perspective view of the stand 100 of FIG. 1A. FIG. 1C is an upper left perspective view of the stand 100 of FIG. 1A. FIG. 1D is an upper right perspective view of the stand 100 of FIG. 1A.

Figure 2A:
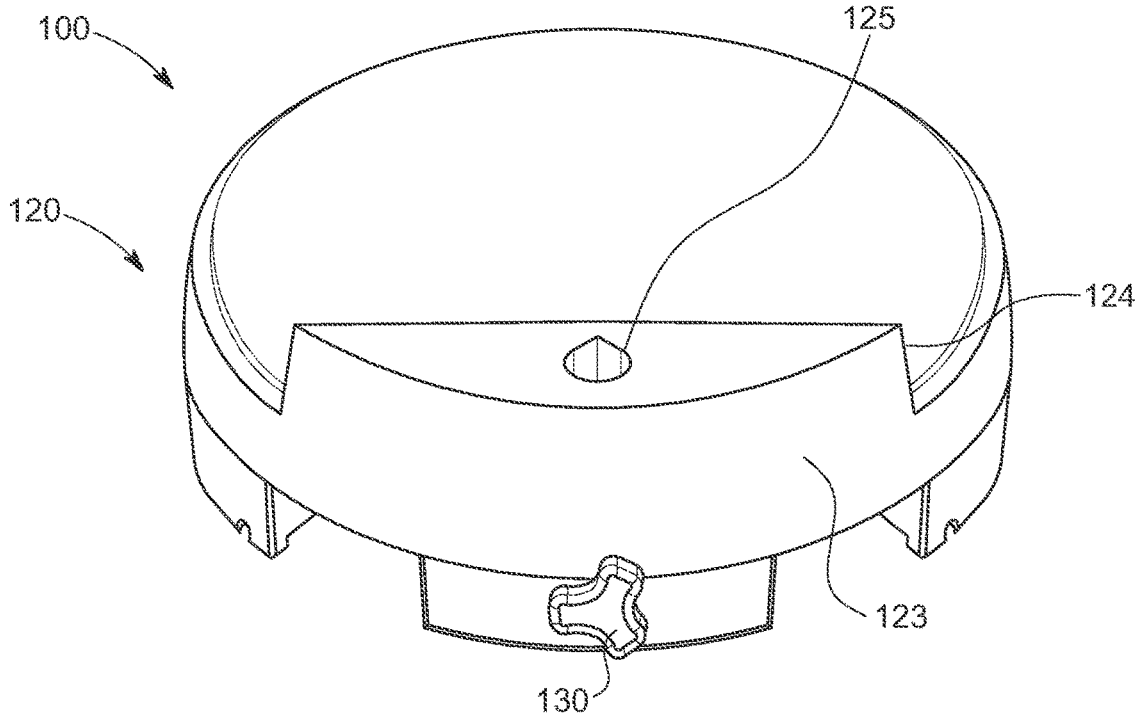
FIG. 2A is a lower front perspective view of the stand of FIG. 1A.
Figure 2B:
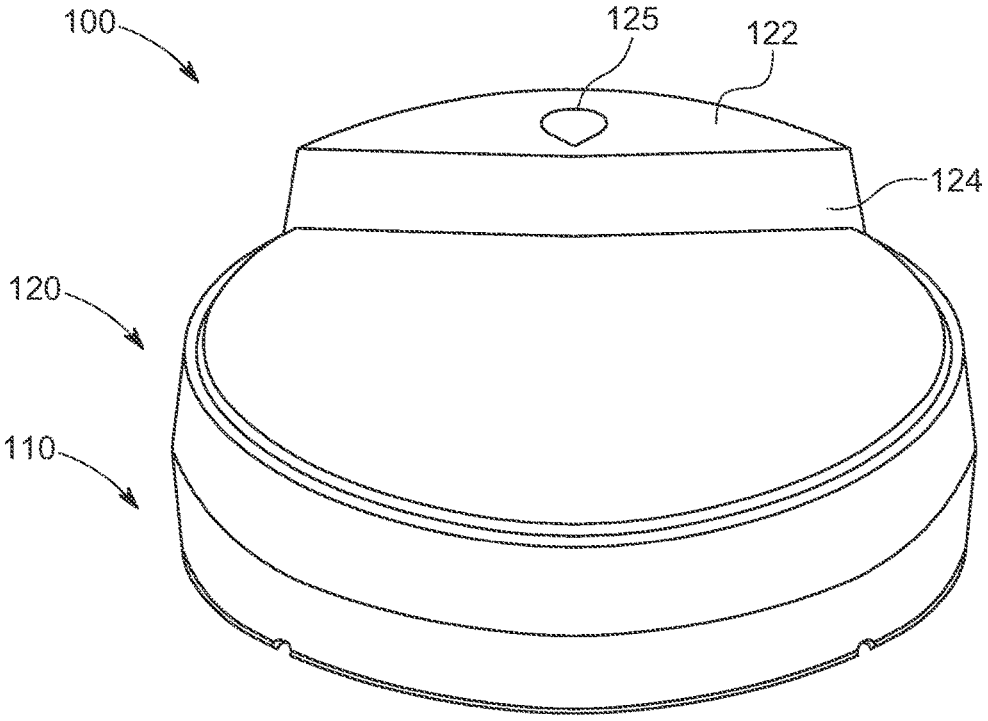
FIG. 2B is a lower rear perspective view of the stand of FIG. 1A.
Figure 2C:
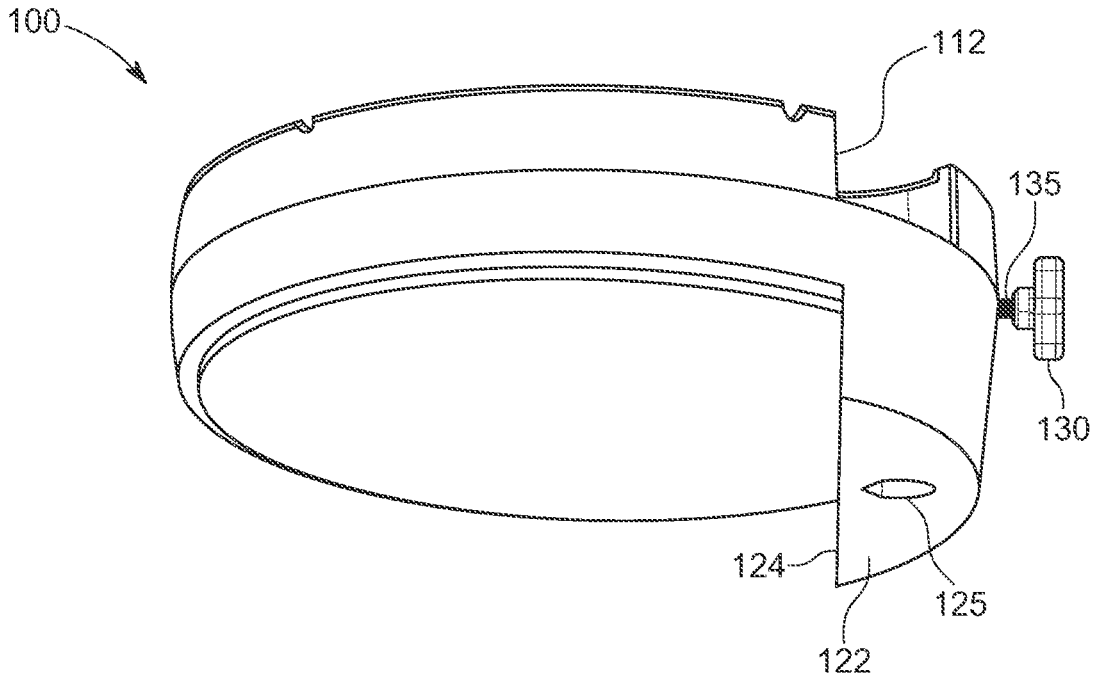
FIG. 2C is a lower left perspective view of the stand of FIG. 1A.
Figure 2D:
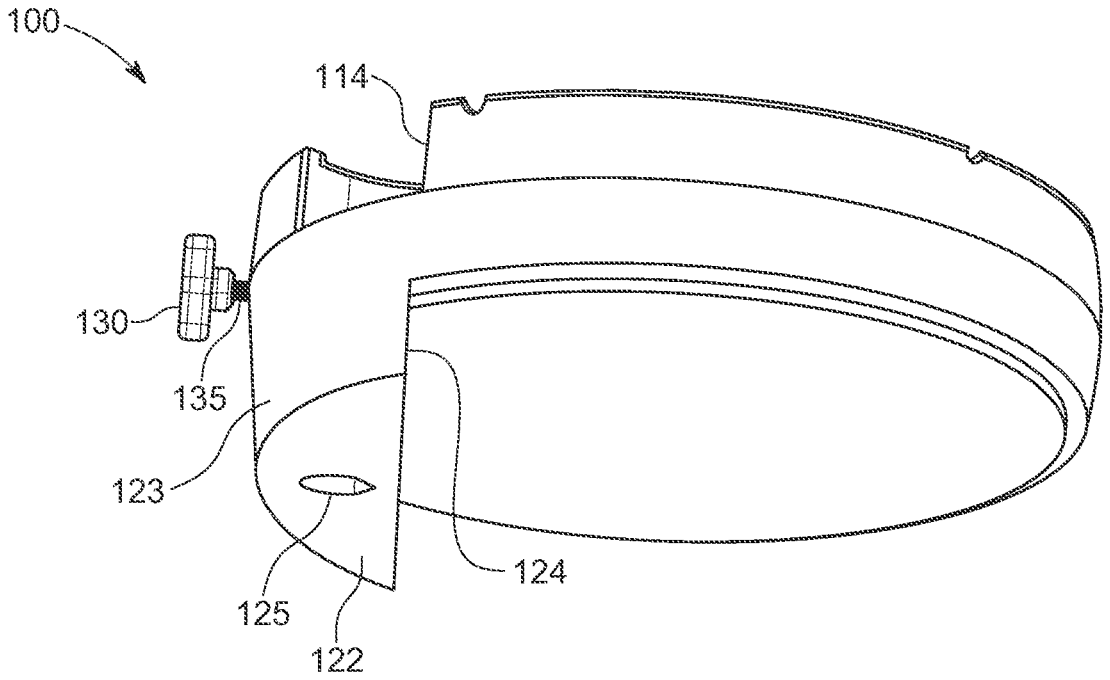
FIG. 2D is a lower right perspective view of the stand of FIG. 1A.

FIG. 2A is a lower front perspective view of the stand 100 of FIG. 1A. FIG. 2B is a lower rear perspective view of the stand 100 of FIG. 1A. FIG. 2C is a lower left perspective view of the stand 100 of FIG. 1A. FIG. 2D is a lower right perspective view of the stand 100 of FIG. 1A.

Figure 3A:
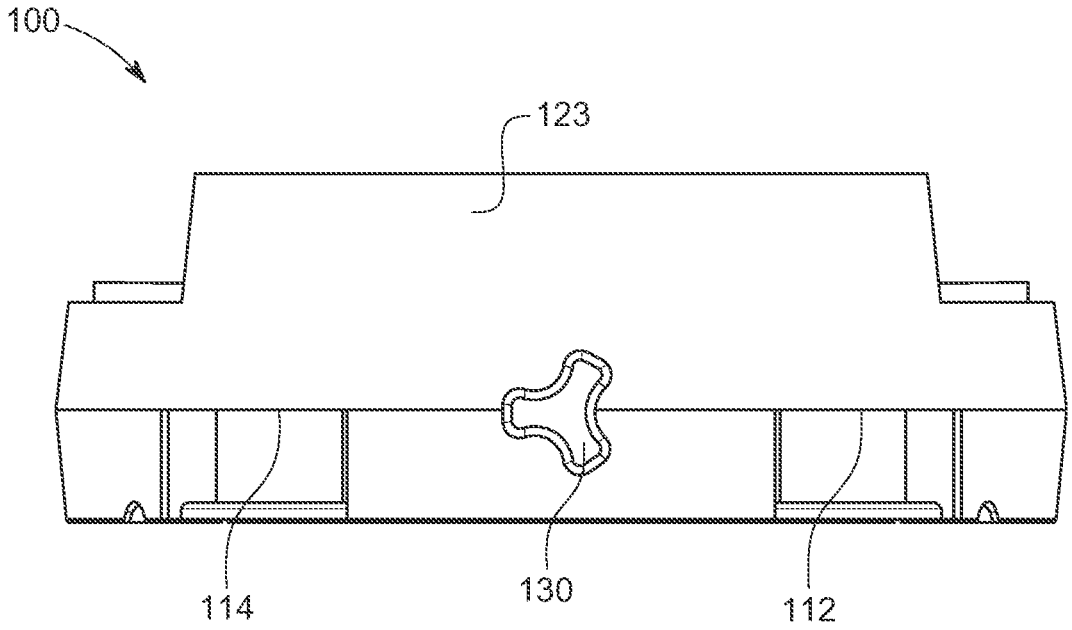
FIG. 3A is a front view of the stand of FIG. 1A.
Figure 3B:
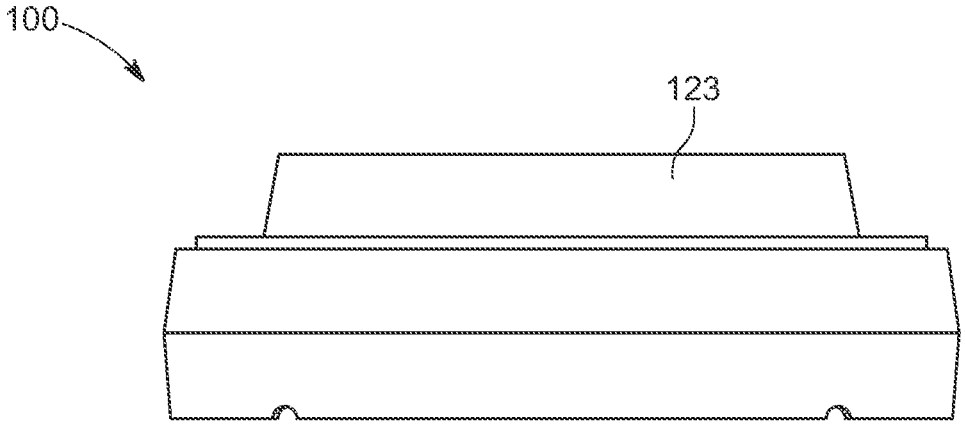
FIG. 3B is a rear view of the stand of FIG. 1A.
Figure 3C:
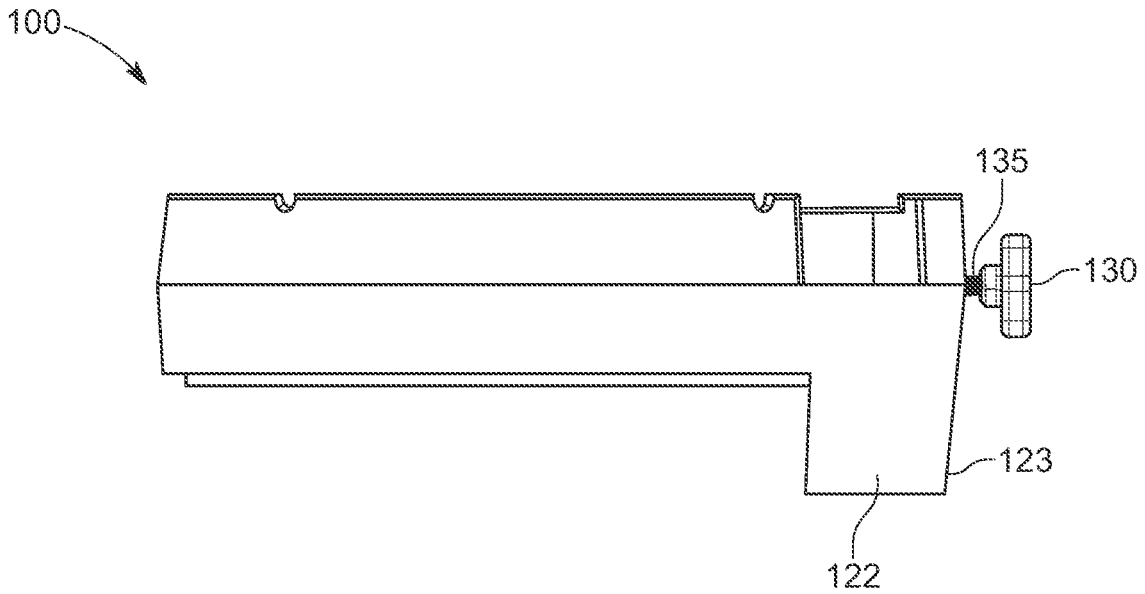
FIG. 3C is a left side view of the stand of FIG. 1A.
Figure 3D:
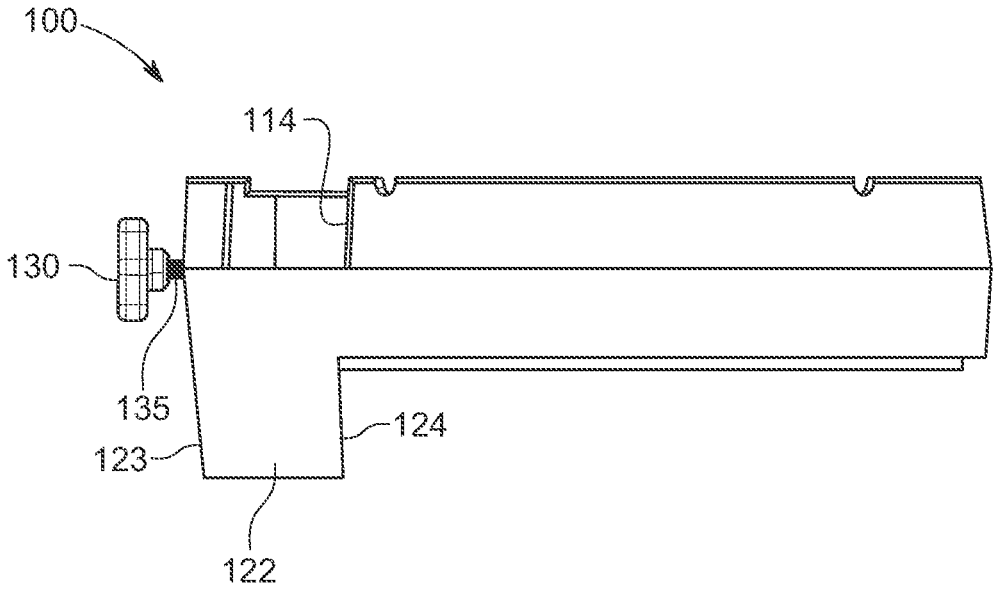
FIG. 3D is a right side view of the stand of FIG. 1A.
Figure 3E:
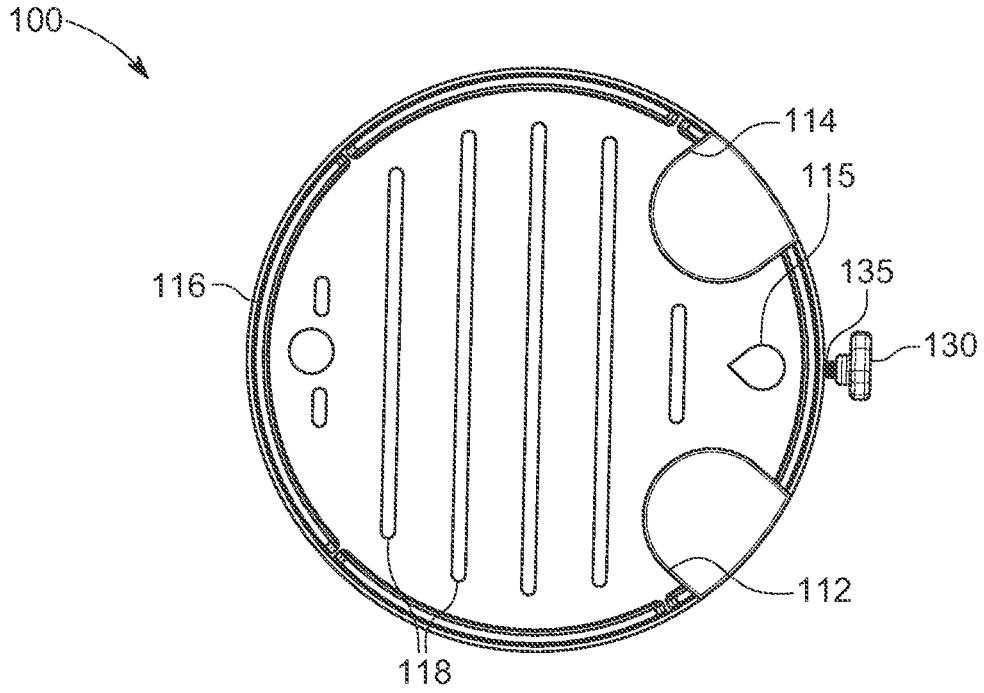
FIG. 3E is a top view of the stand of FIG. 1A.
Figure 3F:
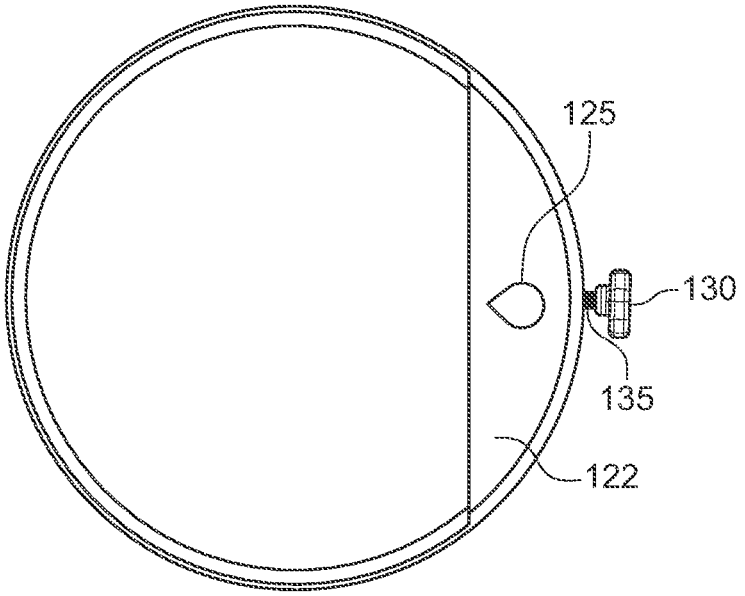
FIG. 3F is a bottom view of the stand of FIG. 1A.

FIG. 3A is a front view of the stand 100 of FIG. 1A. FIG. 3B is a rear view of the stand 100 of FIG. 1A. FIG. 3C is a left side view of the stand 100 of FIG. 1A. FIG. 3D is a right side view of the stand 100 of FIG. 1A. FIG. 3E is a top view of the stand 100 of FIG. 1A. FIG. 3F is a bottom view of the stand 100 of FIG. 1A.

Referring to FIGS. 1A-3F, the stand 100 can have a generally circular disc shape with an outer diameter of approximately 15.99 inches, and be formed from molded plastic having two parts with an upper generally disc member 110 above a lower generally disc member 120.

The approximate overall dimensions of the base can be approximately 3.5 inches tall by approximately 16 inches in diameter.

The upper member 110 and the lower member 120 can be formed from injection molded plastic and the like, and be solid.

The upper member 110 and the lower member 120 can have a hollow interior, with a fill cap 105 to allow the stand to be filled with a ballast, such as water or sand. For example, pool water can be used to fill the hollow interior.

Alternatively, the upper member 110 and the lower member 120 can be solid molded form.

The upper disc member 110 can have a front left rounded indentation for supporting a beverage holder, and a front right rounded indentation for supporting a beverage holder. The upper surface of the upper disc member 110 can have a raised rim edge 116, and parallel raised ridges 118 that can form a gripping surface thereon. A round edge 113 can be circumferentially about the upper member 110.

A through-hole 115 in the upper disc member 110 can have a teardrop shape or oval shape or triangular shape therethrough.

The lower disc member 120 can have a similar diameter to the upper member 110 and thickness. The lower member 120 can have a front step member portion 122 with a rounded front edge 123, and a rear step edge 124. A through-hole 125 similar to the shape of through-hole 115 can pass through the lower member 120.

A clamping screw/knob 130 can have a threaded stem member 135 which passes through a front portion of the upper member 110 and lower member 120. The end of the threaded stem 135 can inter into the through-hole 115/125.

Figure 4A:
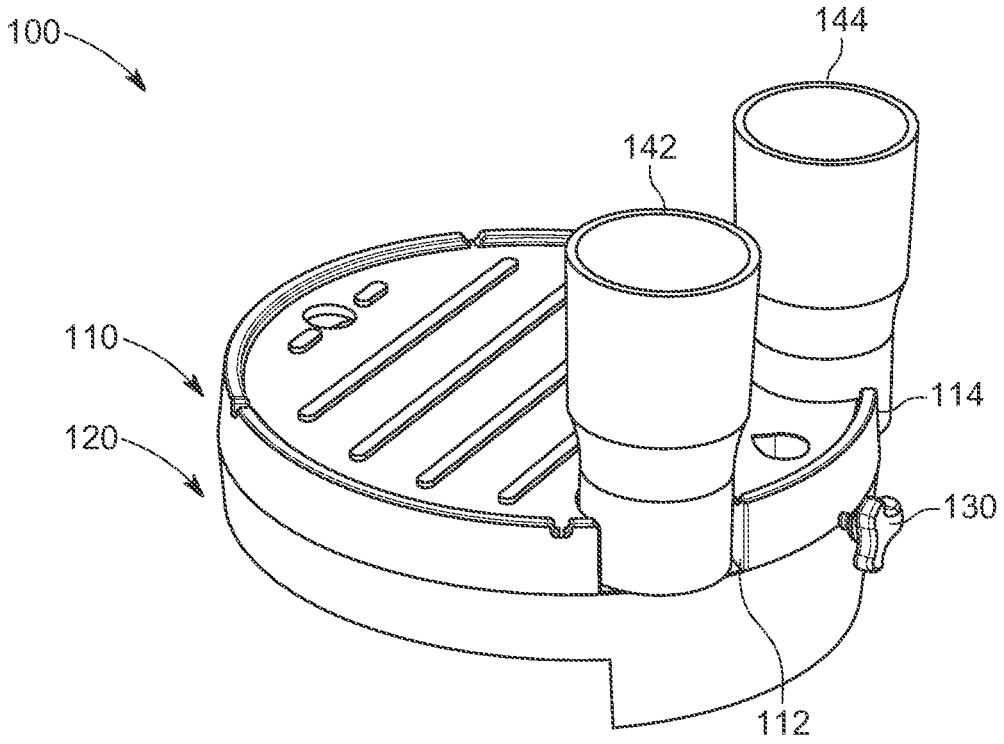
FIG. 4A is an upper front left perspective view of the stand of FIG. 1A supporting two beverage holders.
Figure 4B:
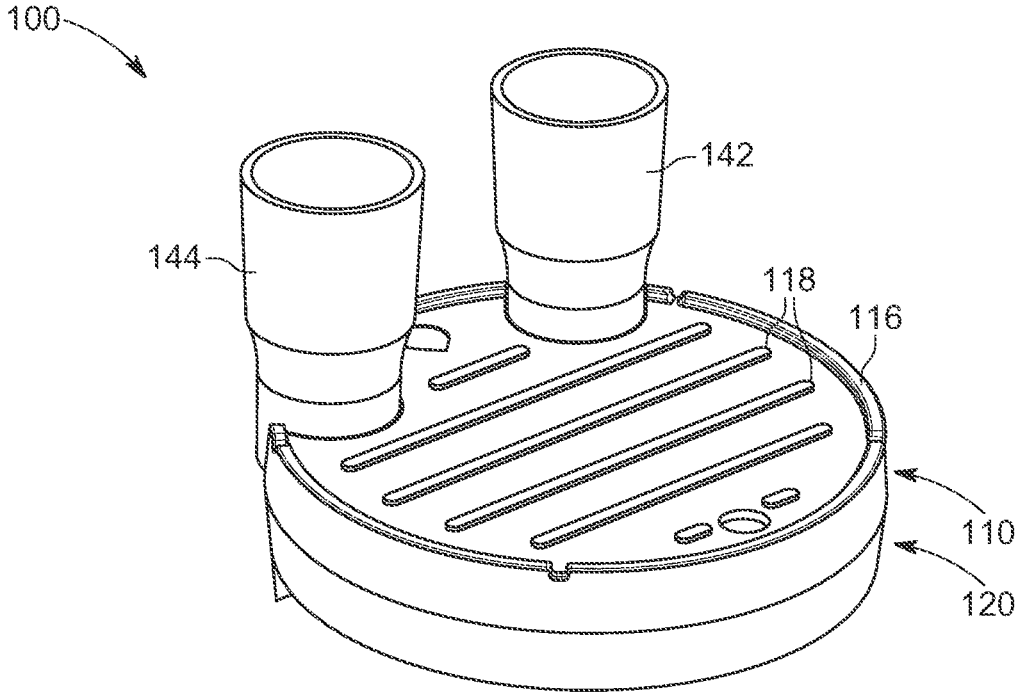
FIG. 4B is an upper rear right perspective view of FIG. 4A.

FIG. 4A is an upper front left perspective view of the stand 100 of FIG. 1A supporting two beverage holders 142, 144. FIG. 4B is an upper rear right perspective view of FIG. 4A.

Referring to FIGS. 4A-4B, the stand 100 is shown supporting one beverage holder 142 in left indentation 112, and another beverage holder 144 in right indentation 114.

Figure 5:
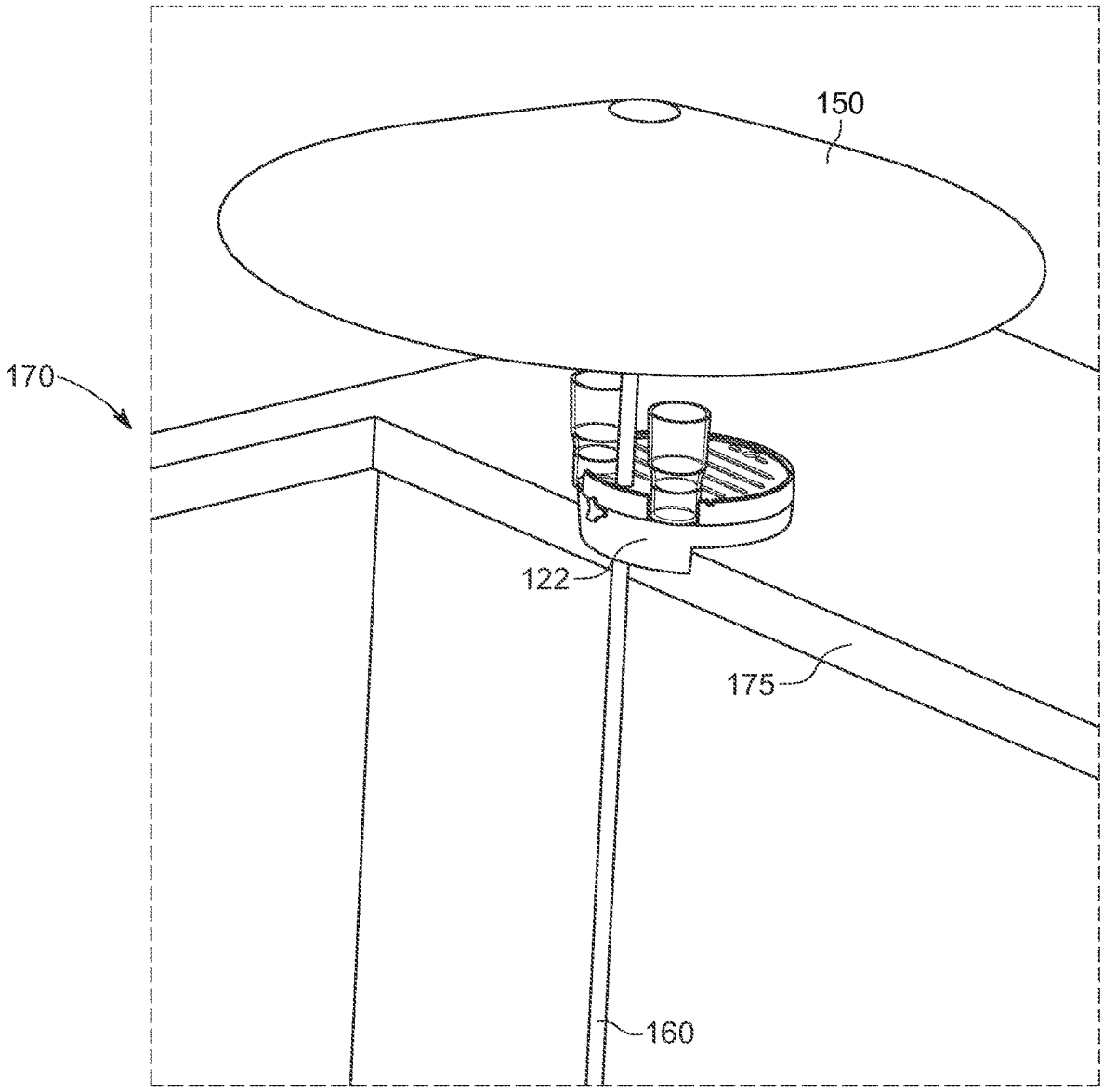
FIG. 5 is a perspective view of the stand with beverage containers of FIGS. 4A-4B supported on an edge of a swimming pool with an umbrella post clamped to the stand.

FIG. 5 is a perspective view of the stand 100 with beverage containers 142, 144 of FIGS. 4A-4B supported on an edge 175 of a swimming pool 170 with an umbrella post 160 clamped to the stand 100. The umbrella post 160 can have an umbrella canopy 150 thereon.

Referring to FIGS. 1A-5, the user can position the umbrella post 160 in the through-holes 115, 125 of the stand 100, so that the bottom of the umbrella post 160 can rest on the bottom of the pool 170, while the step edge 124 of the front step member 122 rests against the swimming pool edge 175.

In the first embodiment 100, the stand 100 can have a small portion 122 overhanging (cantilevered) over the edge 175 of the swimming pool 170, so that substantially most of the mass of the stand 100 is supported by the upper surface of the edge 175 of the swimming pool 170.

The clamping screw/knob 130 can be rotated so that the threaded stem 135 pushes one side of the umbrella post 160 into a narrow portion of the through-holes 115/125 to lock umbrella post 160 in place.

The upper raised ridges 118 on the stand 100 can be used as a nonslip surface to allow items, such as but not limited to smart phones, sunglasses, and the like to be supported on the stand 100.

Second Embodiment Rectangular Stand

FIG. 6A is an upper front perspective view of a second embodiment stand 200 for supporting beverage containers and a pool umbrella post. FIG. 6B is an upper rear perspective view of the stand 200 of FIG. 6A. FIG. 6C is an upper left perspective view of the stand 200 of FIG. 6A. FIG. 6D is an upper right perspective view of the stand 200 of FIG. 6A.

FIG. 7A is a lower front perspective view of the stand 200 of FIG. 6A. FIG. 7B is a lower left perspective view of the stand 200 of FIG. 6A. FIG. 7C is a lower right perspective view of the stand 200 of FIG. 6A.

FIG. 8A is a front view of the stand 200 of FIG. 6A. FIG. 8B is a rear view of the stand 200 of FIG. 6A. FIG. 8C is a left view of the stand of FIG. 6A.

FIG. 8D is a right view of the stand 200 of FIG. 6A.

FIG. 9 is a top view of the stand 200 of FIG. 6A.

Referring to FIGS. 6A to 9, the stand 200 can have a generally rectangular configuration with a rounded front edge 213, and flat angled sides and rear wall 217. The top 210 can have a front left indentation 212 for supporting a beverage holder and front right indentation 214 for supporting another beverage holder. A through-hole 215 similar in shape to the through-holes 115/125 in the previous embodiment can pass from the top side through the bottom side of the stand 200. Opposite facing cut-outs 219 can pass through the top side 210 of the stand 200. Raised parallel ridges 218 can on the top side, and function similar to the raised ridges 118 in the previous embodiment.

A clamping screw/knob 230 with threaded stem can pass through the rounded front edge 213 with an inner end that can press against the side of an umbrella post inserted into the through-hole 215.

The bottom of the stand 200 can have a generally flat bottom surface.

Under the rounded front edge 213 can be a front step member 222 with a rear step edge 224, which can work similar to the like members in the previous embodiment.

Stands 100/200 can have a hollow interior, with a fill cap 105 to allow the stand to be filled with a ballast, such as water or sand. Alternatively, the stands 100/200 can be formed from injection molded plastic and the like, and be solid.

FIG. 10A is an upper front left perspective view of the stand of 200 FIG. 6A supporting two beverage holders 142 and 144. FIG. 10B is an upper rear right perspective view of FIG. 10A.

Referring to FIGS. 10A-10B, beverage holders 142, 144 can be supported in the indentations 212, 214, and the raised ridges 218 can function as a similar nonslip surface similar to the ridges 118 in the previous embodiment.

FIG. 11 is a perspective view of the stand 200 with beverage containers 142, 144 of FIGS. 10A-10B supported on an edge 175 of a swimming pool 170 with an umbrella post 160 clamped to the stand 200 by the clamping screw/knob 230.

In the second embodiment 200, the stand 200 can have a small portion 242 overhanging (cantilevered) over the edge 175 of the swimming pool 170, so that substantially most of the mass of the stand 200 is supported by the upper surface of the edge 175 of the swimming pool 170.

The clamping screw/knob 230 can be rotated so that the threaded stem 235 pushes one side of the umbrella post 160 into a narrow portion of the through-holes 215 to lock umbrella post 160 in place.

The upper raised ridges 218 on the stand 200 can be used as a nonslip surface to allow items, such as but not limited to smart phones, sunglasses, and the like to be supported on the stand 200.

The rectangular cut-out in the top of the stand can be used as a support for a portable cooler, such as but not limited to a portable cooler having a footprint of approximately 11.5 inches by approximately 8 inches.

Stands 100, 200 can be formed to be stackable on top of one another in order to reduce storage space and allow for ease in transport.

While the stands are described for use on an edge of a swimming pool, the stands can be used in other applications. For example, the stands can be positioned on the edges of outdoor tables, such as picnic tables, where the bottom of the umbrella post abuts the ground. Additionally, the stands can be place on tailgates of trucks to be used for tail gating, with the umbrella post abutting the ground. In these other applications the umbrella can also provide shade to those around it, and the stands can be used for supporting beverage holders, and portable coolers.

Third Embodiment

FIG. 12A is a perspective view of a third embodiment stand 300 for supporting beverage containers and a pool umbrella post, formed from a metal panel. FIG. 12B is another perspective view of the stand 300 of FIG. 12A without the clamping screw/knob 130.

FIG. 13A is a top view of the stand 300 of FIGS. 12A-12B. FIG. 13B is a side view of the stand 300 of FIGS. 12A-12B.

Referring to FIGS. 12A-13B, the stand can be formed from a metal plate 310 formed from aluminum or galvanized metal.

The plate can have a generally rectangular configuration with a length of approximately 16 inches and a width of approximately 14 inches.

A front 311 of the plate can have a downward vertical bent portion 312 with a smaller diameter than the top of the metal plate 310, The downward vertical bent portion 312 can have a height of approximately 5.50 inches, with an inward bent step portion 314 similar to the step portion in the preceding figures.

On top of the plate can be a nonmetal layer 320 adhered thereon, having a plurality of circular indentations 322 for supporting beverage containers thereon. The nonmetal layer 320 can be located between the front 311 and rear 318 of the metal plate 310

A vertical through-hole 315 can pass through the top of the nonmetal layer and the plate having a teardrop shape or oval shape or triangular shape therethrough.

A horizontal through-hole 313 can pass through the downward vertical bent portion 312 for allowing the threaded rod attached to the clamping screw/knob 130. Additional accessory mount through-hole(s) 325 can pass through the nonmetal layer 320 and top of the metal plate 310.

FIG. 14A is a perspective view of the stand 300 of FIGS. 12A-13B about an edge 175 of a swimming pool with an umbrella post 360 clamped to the stand 300 and a cooler 350 as ballast for the stand 300. The stand 300 is assembled similar to the stands of the previous embodiments.

FIG. 14B is a side view of FIG. 14B. The top metal plate 310 rests on a portion of the pool coping 178 of the swimming pool.

FIG. 15A is a perspective view of the stand 300 of FIGS. 12A-13B about an edge 175 of a swimming pool with an umbrella post 160 clamped to the stand 300 and a potted plant 360 as ballast for the stand. The stand 300 is assembled similar to the stands of the previous embodiments The top metal plate 310 rests on a portion of the pool coping 178 of the swimming pool.

FIG. 15B is a side view of FIG. 15A.

FIG. 16A is a perspective view of the stand 300 of FIGS. 12A-13B about an edge 175 of a swimming pool with an umbrella post 160 clamped to the stand 300 with an approximate 35 pound weight 370 as ballast for the stand 300.

FIG. 16B is a side view of FIG. 16A. The stand 300 is assembled similar to the stands of the previous embodiments. The top metal plate 310 rests on a portion of the pool coping 178 of the swimming pool.

FIG. 17A is a perspective exploded view of the stand 300 of FIGS. 12A-13B along with an optional portable phone holder 400. FIG. 17B is a perspective assembled view of the stand 300 in FIG. 17A with the portable phone holder 400 mounted.

FIG. 18A is a perspective view of the portable phone holder 400 shown in FIGS. 17A-17B. FIG. 18B is a front view of the portable phone holder 400 of FIG. 18A. FIG. 18C is a side view of the portable phone holder 400 of FIG. 18A.

Referring to FIGS. 12A and 17A-18B, a portable phone holder 40 can include a back plate 410 with a lower ledge 420 having an upward bent edge 424 with ledge tip(s) 426. A post 430 extends downward from the portable phone holder 400. The back plate 410 can have rectangular configuration with a width of approximately 5 inches and height of approximately 2.67 inches with an oval opening therethrough. The ledge 420 can run the width of the holder 400, and include an upward bent edge 424 with ledge tip(s) 426, which can support a portable phone 340 thereon.

The post 530 can be mounted in one of the accessory mount hole(s) 325 through the nonmetal layer 320 and top of metal plate 310.

While ballasts have been described as being weights caused by potted plants, coolers, and approximately 35 pound weights, the ballast can include weights caused by other items, such as but not limited to chair legs, chaise lounge legs, and the like.

The term "approximately"/"approximate" can be +/−10% of the amount referenced. Additionally, preferred amounts and ranges can include the amounts and ranges referenced without the prefix of being approximately.

Although specific advantages have been enumerated above, various embodiments may include some, none, or all of the enumerated advantages.

Modifications, additions, or omissions may be made to the systems, apparatuses, and methods described herein without departing from the scope of the disclosure. For example, the components of the systems and apparatuses may be integrated or separated. Moreover, the operations of the systems and apparatuses disclosed herein may be performed by more, fewer, or other components and the methods described may include more, fewer, or other steps. Steps may be performed in any suitable order. As used in this document, "each" refers to each member of a set or each member of a subset of a set.

To aid the Patent Office and any readers of any patent issued on this application in interpreting the claims appended hereto, applicants wish to note that they do not intend any of the appended claims or claim elements to invoke 35 U.S.C. 112(f) unless the words "means for" or "step for" are explicitly used in the particular claim.

While the invention has been described, disclosed, illustrated and shown in various terms of certain embodiments or modifications which it has presumed in practice, the scope of the invention is not intended to be, nor should it be deemed to be, limited thereby and such other modifications or embodiments as may be suggested by the teachings herein are particularly reserved especially as they fall within the breadth and scope of the claims here appended.

The invention claimed is:

1. A beverage tray and umbrella stand for use with a pool, comprising:

a metal plate having and upper surface and a lower surface, with a front portion and a rear portion, a nonmetal layer on the upper surface with at least one indentation for supporting a beverage container therein, the front portion of the metal plate having a downward vertical bent portion and an inward bent step portion; and a through-hole passing from the upper surface to the lower surface for allowing a post of an umbrella to be supported therein, wherein the vertical bent portion with the inward bent step is adapted to abut a pool coping edge of a swimming pool, and wherein ballast resting on top of the nonmetal layer adjacent the rear portion stabilizes the stand.

2. The beverage tray and umbrella stand of claim 1, wherein the nonmetal layer includes a plurality of generally circular indentations for supporting a plurality of beverage containers therein.

3. The beverage tray and umbrella stand of claim 1, further comprising:

a rotatable knob with a threaded stem adjacent to the through-hole for locking the umbrella to the stand.

4. The beverage tray and umbrella stand of claim 3, wherein the through-hole includes a tear drop configuration, so that an umbrella post is pushed into a narrow portion of the tear drop configuration by the threaded stem of the rotatable knob.

5. The beverage tray and umbrella stand of claim 3, wherein the through-hole includes a triangular configuration, so that an umbrella post is pushed into a narrow portion of the tear drop configuration by the threaded stem of the rotatable knob.

6. The beverage tray and umbrella stand of claim 1, wherein the metal plate is an aluminum plate.

7. The beverage tray and umbrella stand of claim 1, wherein the metal plate is formed from galvanized metal.

8. The beverage tray and umbrella stand of claim 1, wherein the stand is configured to be stackable with an identical stand.

9. The beverage tray and umbrella stand of claim 1, wherein the nonmetal layer includes:

a rear surface portion adapted for supporting a portable cooler as the ballast thereon.

10. The beverage tray and umbrella stand of claim 1, wherein the nonmetal layer includes:

a rear surface portion adapted for supporting a plant as the ballast thereon.

11. The beverage tray and umbrella stand of claim 1, wherein the nonmetal layer includes:

a rear surface portion adapted for supporting an approximately 35 pound weight as the ballast thereon.

12. The beverage tray and umbrella stand of claim 1, wherein the nonmetal layer includes at least one opening for mounting a support post of a portable phone holder thereon.

13. The beverage tray and umbrella stand of claim 1, further comprising:

a portable phone holder having a post that mounts in an accessory hole on a top of the stand, the holder for supporting a portable phone thereon.

14. A beverage tray and umbrella stand kit for use with a pool, the kit comprising:

a metal plate having and upper surface and a lower surface, with a front portion and a rear portion, the upper surface having a nonmetal layer with a plurality of indentations for supporting a beverage container therein, the front portion of the metal plate having a downward vertical bent portion and an inward bent step portion; and a through-hole passing from the upper surface to the lower surface, wherein the vertical bent portion with the inward bent step is adapted to abut a pool coping edge of a swimming pool;

a rotatable knob with a threaded stem passing through the vertical bent portion adjacent to the through-hole; and an umbrella with a post that is inserted into the through for locking the umbrella to the stand, wherein ballast resting on top of the upper surface of the nonmetal layer adjacent the rear portion stabilizes the stand.

15. The beverage tray and umbrella stand of claim 14, wherein the metal plate is selected from an aluminum or galvanized metal.

16. The beverage tray and umbrella stand of claim 14, wherein the nonmetal layer includes:

a rear surface portion adapted for supporting a portable cooler or an approximately 35 pound weight as the ballast thereon.

17. The beverage tray and umbrella stand of claim 14, wherein the nonmetal layer includes at least one opening for mounting a support post of a portable phone holder thereon.

18. A beverage tray and umbrella stand kit for use with a pool, the kit comprising:

a metal plate having and upper surface and a lower surface, with a front portion and a rear portion, the upper surface having a nonmetal layer with a plurality of indentations for supporting a beverage container therein, the front portion of the metal plate having a downward vertical bent portion and an inward bent step portion; and a through-hole passing from the upper surface to the lower surface, wherein the vertical bent portion with the inward bent step is adapted to abut a pool coping edge of a swimming pool;

a rotatable knob with a threaded stem passing through the vertical bent portion adjacent to the through-hole;

an umbrella with a post that is inserted into the through for locking the umbrella to the stand; and a cooler for being used as a ballast for the stand, wherein the ballast resting on top of the upper surface of the metal plate adjacent the rear portion stabilizes the stand.

19. The beverage tray and umbrella stand of claim 18, wherein the nonmetal layer includes at least one opening for mounting a support post of a portable phone holder thereon.

20. The beverage tray and umbrella stand of claim 18, wherein the nonmetal layer includes at least one opening for mounting a support post of a portable phone holder thereon.

* * * * *